US010507958B2

(12) United States Patent
Hashimoto et al.

(10) Patent No.: US 10,507,958 B2
(45) Date of Patent: Dec. 17, 2019

(54) CAP

(71) Applicants: MIKASA INDUSTRY CO., LTD., Koryo-cho, Kitakatsuragi-gun, Nara (JP); KIKKOMAN CORPORATION, Noda-shi, Chiba (JP)

(72) Inventors: Takehisa Hashimoto, Nara (JP); Satoshi Ikeda, Nara (JP); Tatsuhiro Maeda, Nara (JP); Denmi Kuwagaki, Noda (JP)

(73) Assignees: MIKASA INDUSTRY CO., LTD., Kitakatsuragi-gun (JP); KIKKOMAN CORPORATION, Noda-shi (JP)

( * ) Notice: Subject to any disclaimer, the term of this patent is extended or adjusted under 35 U.S.C. 154(b) by 0 days.

(21) Appl. No.: 16/378,658

(22) Filed: Apr. 9, 2019

(65) Prior Publication Data

US 2019/0233181 A1 Aug. 1, 2019

Related U.S. Application Data

(62) Division of application No. 15/757,664, filed as application No. PCT/JP2016/076108 on Sep. 6, 2016, now Pat. No. 10,308,403.

(30) Foreign Application Priority Data

Sep. 7, 2015 (JP) ..... 2015-175260
Oct. 7, 2015 (JP) ..... 2015-198982

(51) Int. Cl.
*B65D 47/20* (2006.01)
*B65D 41/04* (2006.01)
(Continued)

(52) U.S. Cl.
CPC ..... *B65D 47/2081* (2013.01); *B65D 41/04* (2013.01); *B65D 47/0838* (2013.01);
(Continued)

(58) Field of Classification Search
CPC ..... B65D 47/063; B65D 47/205; B65D 47/2056; B65D 47/2062; B65D 47/2018;
(Continued)

(56) References Cited

U.S. PATENT DOCUMENTS 3,705,668 A * 12/1972 Schwartzman .... B65D 47/2075 222/207
3,794,247 A * 2/1974 Corsette ..... B05B 11/043 239/327
(Continued)

FOREIGN PATENT DOCUMENTS

CN 101253104 A 8/2008
CN 103917457 A 7/2014
(Continued)

OTHER PUBLICATIONS

Japanese Office Action issued in connection with Japanese Patent Application No. 2015-175260, dated Jul. 5, 2019 (including English language translation).
(Continued)

*Primary Examiner* — Paul R Durand
*Assistant Examiner* — Randall A Gruby
(74) *Attorney, Agent, or Firm* — Kusner & Jaffe

(57) ABSTRACT

A cap includes a main unit fit onto the mouth of a double-walled container, a spout cylinder provided on the main unit, an inner stopper that is provided in the main unit, and a first inner valve. The inner stopper includes a communicating part that communicates with the inside of the inner container and the inside of the spout cylinder. The first inner valve includes a first valve body that covers the communicating part. The first valve body has passage holes. The first valve body being deformed from a closing position S toward an opening position O keeps acting as a partition between the communicating part and the spout cylinder.

3 Claims, 31 Drawing Sheets

(51) Int. Cl.
*B65D 47/08* (2006.01)
*B65D 47/40* (2006.01)
*B65D 51/16* (2006.01)
*B65D 77/06* (2006.01)

(52) U.S. Cl.
CPC ..... *B65D 47/20* (2013.01); *B65D 47/40* (2013.01); *B65D 51/16* (2013.01); *B65D 77/06* (2013.01)

(58) Field of Classification Search
CPC ..... B65D 47/2031; B65D 47/2075; B65D 47/2081; B65D 47/04; B65D 47/0838; B65D 47/20; B65D 47/40; B65D 77/06; B65D 51/16
See application file for complete search history.

(56) References Cited

U.S. PATENT DOCUMENTS 3,910,467 A * 10/1975 Nilson ..... B65D 47/2081 222/449
4,186,882 A * 2/1980 Szczepanski ..... B05B 11/0059 222/211
4,420,101 A * 12/1983 O'Neill ..... B05B 11/047 137/493
4,485,943 A * 12/1984 Czech ..... B05B 11/3015 222/256
4,506,809 A * 3/1985 Corsette ..... B65D 47/2081 222/213
4,785,978 A * 11/1988 Kano ..... B05B 11/047 215/309
5,033,647 A * 7/1991 Smith ..... B05B 11/0072 222/212
5,154,325 A * 10/1992 Ryder ..... B05B 11/047 222/189.06
5,275,312 A * 1/1994 Labruzzo ..... B05B 11/0064 137/540
5,680,969 A * 10/1997 Gross ..... B65D 47/2031 222/494
5,842,618 A 12/1998 Julemont et al.
5,944,234 A 8/1999 Lampe et al.
6,062,436 A * 5/2000 Fuchs ..... B65D 47/2031 137/846
6,095,382 A * 8/2000 Gross ..... B65D 47/242 215/271
6,250,503 B1 * 6/2001 Dark ..... B65D 47/2018 222/1
6,672,479 B2 1/2004 Shiraishi et al.
6,951,295 B1 * 10/2005 Gaus ..... B05B 11/007 222/484
8,118,183 B2 2/2012 Iwahashi et al.
9,352,897 B2 * 5/2016 Hoshino ..... B65D 47/40
9,815,599 B2 11/2017 Spiegelhoff et al.
2002/0153386 A1 10/2002 Uetake et al.
2004/0007601 A1 * 1/2004 Masuda ..... B65D 47/2075 222/494
2004/0112920 A1 * 6/2004 Felten ..... B65D 47/2075 222/212
2005/0087571 A1 * 4/2005 Dark ..... B65D 47/2081 222/544
2007/0023462 A1 * 2/2007 Pugne ..... B65D 47/0804 222/556
2007/0062906 A1 3/2007 Morano et al.
2011/0144598 A1 6/2011 Mihashi et al.
2011/0290824 A1 12/2011 Smith et al.
2013/0026196 A1 1/2013 Essebaggers et al.
2014/0144938 A1 5/2014 Kakuta et al.
2014/0263443 A1 9/2014 Furusawa et al.
2015/0216723 A1 8/2015 Yoshimura et al.
2018/0111724 A1 4/2018 Sakimura et al.

FOREIGN PATENT DOCUMENTS

JP H05-044845 6/1993
JP 2004-521036 A 7/2004
JP 3688373 B2 8/2005
JP 2011-230843 A 11/2011
JP 2011-251697 A 12/2011
JP 2014-069853 A 4/2014

OTHER PUBLICATIONS

International Search Report from corresponding International Patent Application No. PCT/JP16/76108, dated Nov. 22, 2016.
Office Action issued in corresponding Chinese Patent Application No. 201680051354.6 dated Jan. 11, 2019.

* cited by examiner

CAP

RELATED APPLICATIONS

This application is a divisional of U.S. application Ser. No. 15/757,664, filed on Mar. 6, 2018, which is a U.S. National Stage Application of International Application No. PCT/JP2016/076108, filed Sep. 6, 2016, which claims priority from Japanese Patent Application No. 2015-198982, filed Oct. 7, 2015, and Japanese Patent Application No. 2015-175260, filed Sep. 7, 2015, said patent applications hereby fully incorporated herein by reference.

FIELD OF THE INVENTION

The present invention relates to a cap attached to the mouth of a double-walled container.

BACKGROUND OF THE INVENTION

A known cap in the related art is disclosed in, for example, Japanese Patent No. 3688373. As shown in FIGS. 29 and 30, the cap includes a main unit 203 attached to a mouth 202 of a double-walled container 201, a spout cylinder 204 provided on the main unit 203, a lid 205 for opening and closing the tip opening of the spout cylinder 204, an inner stopper 206 provided in the main unit 203 so as to be fit into the mouth 202, and a valve device 207 provided in the main unit 203.

The inner stopper 206 has a spout 208. The valve device 207 has a fitting portion 209, a disk portion 210, a disk discharge valve 211, and a suction valve. The discharge valve 211 opens and closes the spout 208. The discharge valve 211 is provided on the fitting portion 209 so as to vertically swing via a connecting portion 213. The suction valve is a valve for opening and closing a clearance between an air inlet port 214 and an air inlet passage 215.

The lid 205 contains a cylindrical inner ring 219 on an inner side thereof. When the lid 205 is closed, the inner ring 219 is fit into the tip opening of the spout cylinder 204 so as to seal the tip opening of the spout cylinder 204.

Thus, when a user opens the lid 205 and presses the double-walled container 201 with a hand, the suction valve is closed to act as a partition between the air inlet port 214 and the air inlet passage 215. This prevents air between an outer layer 216 and an inner layer 217 of the double-walled container 201 from being discharged and increases the internal pressure of the double-walled container 201. Thus, as indicated by a virtual line of FIG. 30 and in FIG. 31, the discharge valve 211 opens the spout 208, and then a fluid 218 in the double-walled container 201 is discharged from the spout cylinder 204 through the spout 208.

When the user releases pressure on the double-walled container 201, the internal pressure of the double-walled container 201 falls below an atmospheric pressure due to the restoring force of the outer layer 216 of the double-walled container 201. The discharge valve 211 then closes the spout 208 as indicated by a solid line of FIG. 30, a pressure between the outer layer 216 and the inner layer 217 of the double-walled container 201 falls below an atmospheric pressure, the suction valve is opened, and then air is fed between the outer layer 216 and the inner layer 217 from the air inlet port 214 through the air inlet passage 215.

In the related art, however, when a user presses the double-walled container 201, the discharge valve 211 quickly (concurrently with the press) opens the spout 208 as indicated by the virtual line of FIG. 30. Thus, as shown in FIG. 31, the fluid 218 in the double-walled container 201 may be rapidly discharged from the spout cylinder 204.

Moreover, when the user releases pressure on the double-walled container 201 and the discharge valve 211 closes the spout 208 as shown in FIG. 32, the fluid 218 may not fully return into the double-walled container 201 from the inside of the spout cylinder 204 through the spout 208. Unfortunately, it is difficult to reduce the amount of the fluid 218 remaining in the spout cylinder 204.

As has been discussed, if a large amount of the fluid 218 remains in the spout cylinder 204, when the lid 205 is closed to fit the inner ring 219 into the tip opening of the spout cylinder 204, the fluid 218 remaining in the spout cylinder 204 may leak out of the spout cylinder 204.

An object of the present invention is to provide a cap that allows sufficient time to discharge a fluid from a spout after a user presses a double-walled container, thereby preventing rapid discharge of the fluid from the spout.

Another object of the present invention is to provide a cap that can reduce the amount of fluid remaining in a spout cylinder when a user releases pressure on a double-walled container.

SUMMARY OF THE INVENTION

In order to attain the objects, a first aspect of a cap attached to the mouth of a double-walled container having a deformable inner container and a deformable outer container according to the present invention includes:

a main unit attached to the mouth of the double-walled container;

a spout cylinder provided on the main unit;

a lid that opens and closes a spout formed at the tip end of the spout cylinder;

an inner stopper that is provided in the main unit so as to be fit into the mouth of the double-walled container; and a first inner valve provided in the main unit, wherein the inner stopper includes a communicating part that communicates with the inside of the inner container and the inside of the spout cylinder, the first inner valve includes a first valve body that covers the communicating part of the inner stopper, the first valve body has at least one passage hole, the first valve body is deformable to an opening position where the first valve body expands into the spout cylinder and to a closing position where the first valve body retracts opposite to the opening position, the first valve body being biased in a closing direction, the first valve body at the closing position acts as a partition between the communicating part of the inner stopper and the spout cylinder, the first valve body at the opening position causes the communicating part of the inner stopper and the spout cylinder to communicate with each other through the passage hole of the first valve body, and the first valve body being deformed from the closing position toward the opening position keeps acting as a partition between the communicating part of the inner stopper and the spout cylinder.

With this configuration, a user opens the lid and presses (compresses) the double-walled container with a hand so as to increase the internal pressure of the double-walled container. This allows the first valve body to deform from the closing position to the opening position and expand into the spout cylinder. Thus, the communicating part of the inner stopper and the spout cylinder communicate with each other through the at least one passage hole of the first valve body, so that a fluid in the inner container flows into the spout cylinder from the communicating part of the inner stopper through the at least one passage hole and is discharged from the spout.

At this point, the first valve body being deformed from the closing position toward the opening position keeps acting as a partition between the communicating part of the inner stopper and the spout cylinder. When the first valve body reaches the opening position, the communicating part of the inner stopper and the spout cylinder communicate with each other through the at least one passage hole. Thus, when the user presses the double-walled container, the communicating part of the inner stopper and the spout cylinder communicate with each other through the at least one passage hole after a time required to deform the first valve body from the closing position to the opening position.

This causes a time lag (delay) between a press to the double-walled container by the user and the discharge of the fluid in the inner container from the spout. Thus, the user can obtain sufficient time to discharge the fluid from the spout after pressing the double-walled container, thereby preventing rapid discharge of the fluid from the spout.

The user releases pressure on the double-walled container so as to deform the first valve body from the opening position to the closing position, causing the first valve body to act as a partition between the communicating part of the inner stopper and the spout cylinder.

According to a second aspect of the cap of the present invention, the communicating part is an inner cylinder with one end communicating with the inside of the inner container and the other end communicating with the inside of the spout cylinder, the first valve body covers the opening of the inner cylinder, the first valve body is deformable to the closing position where the first valve body retracts concavely into the inner cylinder and to the opening position where the first valve body expands convexly into the spout cylinder, the first valve body at the closing position acts as a partition between the inside of the inner cylinder and the inside of the spout cylinder, the first valve body at the opening position causes the inside of the inner cylinder and the inside of the spout cylinder to communicate with each other through the passage hole of the first valve body, and the first valve body being deformed from the closing position toward the opening position keeps acting as a partition between the inside of the inner cylinder and the inside of the spout cylinder.

With this configuration, the user opens the lid and presses the double-walled container with a hand so as to increase the internal pressure of the double-walled container. This deforms the first valve body from the closing position where the first valve body retracts concavely into the inner cylinder to the opening position where the first valve body expands convexly into the spout cylinder. Thus, the inside of the communicating part of the inner stopper and the inside of the spout cylinder communicate with each other through the at least one passage hole of the first valve body, so that a fluid in the inner container flows into the spout cylinder from the inside of the inner cylinder through the at least one passage hole and then is discharged from the spout.

At this point, the first valve body being deformed from the closing position toward the opening position keeps acting as a partition between the inside of the inner cylinder and the inside of the spout cylinder. When the first valve body reaches the opening position, the inside of the inner cylinder and the inside of the spout cylinder communicate with each other through the at least one passage hole. Thus, when the user presses the double-walled container, the inside of the inner cylinder and the inside of the spout cylinder communicate with each other through the at least one passage hole after a time required to deform the first valve body from the closing position to the opening position.

This causes a time lag (delay) between a press to the double-walled container by the user and the discharge of the fluid in the inner container from the spout. Thus, the user can obtain sufficient time to discharge the fluid from the spout after pressing the double-walled container, thereby preventing rapid discharge of the fluid from the spout.

The user releases pressure on the double-walled container so as to deform the first valve body from the opening position where the first valve body expands convexly into the spout cylinder to the closing position where the first valve body retracts concavely into the inner cylinder. This causes the first valve body to act as a partition between the inside of the inner cylinder and the inside of the spout cylinder. In this way, the first valve body being closed is deformed from a convex shape expanding into the spout cylinder to a concave shape retracting into the inner cylinder. Thus, the level of a fluid remaining in the spout cylinder is drawn into the spout cylinder according to a volume corresponding to the deformation amount of the first valve body. This can prevent the fluid remaining in the spout cylinder from reaching the spout at the tip end of the spout cylinder.

According to a third aspect of the cap of the present invention, the spout cylinder includes a storage part that stores the first valve body and a spout passage that communicates with the spout from the storage part, the spout passage has a smaller diameter than the storage part, the passage hole includes multiple passage holes formed on the circumference of the first valve body facing the end of the inner cylinder, and the spout cylinder has a guide surface that is formed so as to guide, to the spout passage, a fluid having flown to the storage part in the spout cylinder from the inside of the inner cylinder through the passage holes.

With this configuration, the user opens the lid and presses the double-walled container, so that the fluid in the inner container flows into the storage part in the spout cylinder from the inside of the inner cylinder through the passage holes, is guided to the guide surface, smoothly flows to the spout passage from the storage part, and then is discharged from the spout. This can radially discharge the fluid from the spout without disturbing the flow of the fluid in the spout cylinder.

According to a fourth aspect of the cap of the present invention, the first valve body has a protrusion that is circumferentially pressed to the end of the inner cylinder at the closing position, the passage hole is located outside the protrusion in a radial direction of the first valve body, the first valve body at the closing position presses the protrusion to the end of the inner cylinder so as to act as a partition between the inside of the inner cylinder and the inside of the spout cylinder, the first valve body at the opening position separates the protrusion from the end of the inner cylinder, causing the inside of the inner cylinder and the inside of the spout cylinder to communicate with each other through the passage holes of the first valve body, and the first valve body being deformed from the closing position toward the opening position presses the protrusion to the end of the inner cylinder so as to keep acting as a partition between the inside of the inner cylinder and the inside of the spout cylinder.

With this configuration, when a user opens the lid and presses the double-walled container, the first valve body being deformed from the closing position toward the opening position presses the protrusion to the end of the inner cylinder, so that the first valve body keeps acting as a partition between the inside of the inner cylinder and the inside of the spout cylinder. When the first valve body reaches the opening position, the protrusion separates from the end of the inner cylinder, causing the inside of the inner cylinder and the inside of the spout cylinder to communicate with each other through the passage holes of the first valve body. Thus, when the user presses the double-walled container, the inside of the inner cylinder and the inside of the spout cylinder communicate with each other through the passage holes after a time required to deform the first valve body from the closing position to the opening position.

The user releases pressure on the double-walled container so as to deform the first valve body from the opening position where the first valve body expands convexly into the spout cylinder to the closing position where the first valve body retracts concavely into the inner cylinder. Thus, the protrusion is pressed to the end of the inner cylinder, causing the first valve body to act as a partition between the inside of the inner cylinder and the inside of the spout cylinder. This can firmly seal a clearance between the first valve body and the end of the inner cylinder, thereby reliably preventing air in the spout cylinder from entering the inner container from the clearance between the first valve body and the end of the inner cylinder.

At the closing position, the protrusion is pressed substantially in line contact with the end of the inner cylinder. This can increase a contact force per unit area and sealing performance, thereby providing sufficient shielding capability for the first valve body. Furthermore, this can reduce a pressure required to press the double-walled container by the user so as to deform the first valve body from the closing position to the opening position.

According to a fifth aspect of the cap of the present invention, the main unit has an air inlet port that draws outside air into a clearance between the inner container and the outer container, the main unit contains a communication passage that communicates with the air inlet port and the clearance between the inner container and the outer container, and contains a second inner valve that opens and closes the air inlet port, and the second inner valve is integrated with the first inner valve.

With this configuration, a user opens the lid and presses the double-walled container, so that the second inner valve closes the air inlet port. This increases the internal pressure of the double-walled container and deforms the first valve body from the closing position to the opening position. Thus, the communicating part of the inner stopper and the spout cylinder communicate with each other through the passage holes of the first valve body, so that a fluid in the inner container flows into the spout cylinder from the communicating part of the inner stopper through the passage holes and then is discharged from the spout.

When the user releases pressure on the double-walled container, the internal pressure of the double-walled container falls below an atmospheric pressure and the second inner valve opens the air inlet port. Thus, air passes through the communication passage from the air inlet port and is fed to the clearance between the inner container and the outer container. Moreover, the first valve body is deformed from the opening position to the closing position so as to act as a partition between the communicating part of the inner stopper and the spout cylinder.

According to a sixth aspect of the cap of the present invention, the air inlet port and the communication passage are formed at a point in the circumferential direction of the main unit, the second inner valve includes a support member that is fixed between the main unit and the inner stopper and a second valve body that is provided on the support member so as to be elastically deformed, the second valve body has a proximal end that is provided on the support member, when the pressure of the clearance between the inner container and the outer container exceeds an atmospheric pressure, the free end of the second valve body is pressed to the inner surface of the main unit so as to close the air inlet port, and when the pressure of the clearance between the inner container and the outer container falls below an atmospheric pressure, the free end of the second valve body separates from the inner surface of the main unit so as to open the air inlet port.

With this configuration, a user opens the lid and presses the double-walled container, so that the pressure of the clearance between the inner container and the outer container exceeds an atmospheric pressure. At this point, the free end of the second valve body is pressed to the inner surface of the main unit so as to close the air inlet port. This increases the internal pressure of the double-walled container and deforms the first valve body from the closing position to the opening position. Thus, the communicating part of the inner stopper and the spout cylinder communicate with each other through the passage holes of the first valve body.

When the user releases pressure on the double-walled container, the pressure of the clearance between the inner container and the outer container falls below an atmospheric pressure. This separates the free end of the second valve body from the inner surface of the main unit so as to open the air inlet port. Thus, air is fed to the clearance between the inner container and the outer container from the air inlet port through the communication passage, the first valve body is deformed from the opening position to the closing position, and the first valve body acts as a partition between the communicating part of the inner stopper and the spout cylinder.

The air inlet port and the communication passage are formed at a point in the circumferential direction of the main unit. The proximal end of the second valve body is provided on the support member and the free end of the second valve body can be pressed to or separated from the inner surface of the main unit. Thus, the second valve body can sensitively react with a pressure change of the clearance between the inner container and the outer container so as to quickly open or close the air inlet port.

According to a seventh aspect of the cap of the present invention, when the pressure of the clearance between the inner container and the outer container is equal to an atmospheric pressure, a small clearance is formed between the free end of the second valve body and the inner surface of the main unit, and the air inlet port and the communication passage communicate with each other through the small clearance.

With this configuration, under normal conditions where a user does not press the double-walled container and the outer container is not deformed, the air inlet port and the communication passage communicate with each other through the small clearance. Thus, for example, even if the double-walled container reaches a higher temperature than outside air and air thermally expands in the clearance between the inner container and the outer container, the thermally expanding air flows into the air inlet port from the communication passage through the small clearance and then is discharged out of the air inlet port. This can achieve a balance between an internal pressure and an external pressure of the double-walled container through the small clearance under the normal conditions. This can prevent air in the clearance between the inner container and the outer container from thermally expanding so as to raise a pressure in the double-walled container, thereby preventing the level of a fluid in the double-walled container from rising without a press to the double-walled container by the user.

An eighth aspect of the cap attached to the mouth of a double-walled container having a deformable inner container and a deformable outer container according to the present invention includes:

a main unit attached to the mouth of the double-walled container;

a spout cylinder provided on the main unit;

a lid that opens and closes a spout formed at the tip end of the spout cylinder;

an inner stopper that is provided in the main unit so as to be fit into the mouth of the double-walled container; and a first inner valve provided in the main unit, wherein the inner stopper includes an inner cylinder with one end communicating with the inside of the inner container and the other end communicating with the inside of the spout cylinder, the first inner valve includes a first valve body that covers the opening of the inner cylinder, the first valve body has a passage hole, the first valve body is deformable to an opening position where the first valve body expands convexly into the spout cylinder and to a closing position where the first valve body retracts concavely into the inner cylinder, the first valve body being biased in a closing direction, the first valve body at the closing position acts as a partition between the inside of the inner cylinder and the inside of the spout cylinder, and the first valve body at the opening position causes the inside of the inner cylinder and the inside of the spout cylinder to communicate with each other through the passage hole of the first valve body.

With this configuration, a user opens the lid and presses the double-walled container with a hand, so that the internal pressure of the double-walled container increases and the first valve body is deformed from the closing position where the first valve body retracts concavely into the inner cylinder to the opening position where the first valve body expands convexly into the spout cylinder. Thus, the inside of the inner cylinder and the inside of the spout cylinder communicate with each other through the passage hole of the first valve body, so that a fluid in the inner container flows into the spout cylinder from the inside of the inner cylinder through the passage hole and then is discharged from the spout.

The user releases pressure on the double-walled container so as to deform the first valve body from the opening position where the first valve body expands convexly into the spout cylinder to the closing position where the first valve body retracts concavely into the inner cylinder, causing the first valve body to act as a partition between the inside of the inner cylinder and the inside of the spout cylinder.

In this way, the first valve body being closed is deformed from a convex shape expanding into the spout cylinder to a concave shape retracting into the inner cylinder, so that a fluid in the spout cylinder is mostly drawn into the inner cylinder according to the deformation of the first valve body. This can reduce the amount of the fluid remaining in the spout cylinder after the first valve body is closed.

According to a ninth aspect of the cap of the present invention, the passage hole has a first passage hole that is formed at the center of the first valve body, the inner cylinder contains a communicating path that communicates with the inside of the inner container and the inside of the spout cylinder, and contains a closing member, the first valve body at the closing position comes into contact with the closing member and closes the first passage hole with the closing member, and the first valve body at the opening position separates from the closing member, causing the inside of the inner cylinder and the inside of the spout cylinder to communicate with each other through the first passage hole.

With this configuration, a user opens the lid and presses the double-walled container, so that the internal pressure of the double-walled container increases and the first valve body is deformed from the closing position where the first valve body retracts concavely into the inner cylinder to the opening position where the first valve body expands convexly into the spout cylinder. Thus, the first valve body separates from the closing member, the inside of the inner cylinder and the inside of the spout cylinder communicate with each other through the first passage hole, and the content fluid in the inner container flows into the spout cylinder from the inside of the inner cylinder through the first passage hole and is discharged from the spout.

The user releases pressure on the double-walled container so as to deform the first valve body from the opening position where the first valve body expands convexly into the spout cylinder to the closing position where the first valve body retracts concavely into the inner cylinder. Thus, the first valve body comes into contact with the closing member, the first passage hole is closed by the closing member, and the first valve body acts as a partition between the inside of the inner cylinder and the inside of the spout cylinder.

According to a tenth aspect of the cap of the present invention, the passage hole has a second passage hole formed around the first passage hole, the first valve body at the closing position comes into contact with the end of the inner cylinder and closes the second passage hole on the end of the inner cylinder, the first valve body at the opening position separates from the end of the inner cylinder, causing the inside of the inner cylinder and the inside of the spout cylinder to communicate with each other through the first and second passage holes.

With this configuration, a user opens the lid and presses the double-walled container, so that the internal pressure of the double-walled container increases and the first valve body is deformed from the closing position where the first valve body retracts concavely into the inner cylinder to the opening position where the first valve body expands convexly into the spout cylinder. Thus, the first valve body separates from the closing member and the end of the inner cylinder, the inside of the inner cylinder and the inside of the spout cylinder communicate with each other through the first and second passage holes, and a content fluid in the inner container flows into the spout cylinder from the inside of the inner cylinder through the first and second passage holes and then is discharged from the spout.

The user releases pressure on the double-walled container so as to deform the first valve body from the opening position where the first valve body expands convexly into the spout cylinder to the closing position where the first valve body retracts concavely into the inner cylinder. Thus, the first valve body comes into contact with the closing member and the end of the inner cylinder, the first passage hole is closed by the closing member, the second passage hole is closed by the end of the inner cylinder, and the first valve body acts as a partition between the inside of the inner cylinder and the inside of the spout cylinder.

According to an eleventh aspect of the cap of the present invention, the main unit has an air inlet port that draws outside air into a clearance between the inner container and the outer container, the main unit contains a communication passage that communicates with the air inlet port and the clearance between the inner container and the outer container, and a second inner valve that opens and closes the air inlet port, and the second inner valve is integrated with the first inner valve.

With this configuration, a user opens the lid and presses the double-walled container, so that the second inner valve closes the air inlet port. This increases the internal pressure of the double-walled container and deforms the first valve body from the closing position to the opening position. Thus, the inside of the inner cylinder and the inside of the spout cylinder communicate with each other through the passage hole of the first valve body, and a content fluid in the inner container flows into the spout cylinder from the inside of the inner container through the passage hole and then is discharged from the spout.

When the user releases pressure on the double-walled container such that the internal pressure of the double-walled container falls below an atmospheric pressure, the second inner valve opens the air inlet port. Thus, air is fed to the clearance between the inner container and the outer container from the air inlet port through the communication passage, the first valve body is deformed from the opening position to the closing position, and the first valve body acts as a partition between the inside of the inner cylinder and the inside of the spout cylinder.

According to a twelfth aspect of the cap of the present invention, the second inner valve includes a feeding part that feeds a content fluid of the inner container and a second valve body that is opened and closed by the content fluid fed by the feeding part, the second valve body is deformable to a closing position where the second valve body expands into the air inlet port so as to close the air inlet port and an opening position where the second valve body retracts into the feeding part from the inside of the air inlet port so as to open the air inlet port, the second valve body being biased in an opening direction and deformed from the opening position to the closing position by the content fluid fed by the feeding part.

With this configuration, a user opens the lid and presses the double-walled container, so that the content fluid of the inner container is fed to the feeding part and the second valve body is deformed from the opening position to the closing position and expands into the air inlet port so as to close the air inlet port. This increases the internal pressure of the double-walled container and deforms the first valve body from the closing position to the opening position. Thus, the inside of the inner cylinder and the inside of the spout cylinder communicate with each other through the passage hole of the first valve body and a content fluid in the inner container flows into the spout cylinder from the inside of the inner container through the passage hole and then is discharged from the spout.

The user releases pressure on the double-walled container so as to return the content fluid from the feeding part to the inner container. This allows the second valve body to deform from the closing position to the opening position and retract from the inside of the air inlet port to the feeding part so as to open the air inlet port. Thus, air is fed to the clearance between the inner container and the outer container from the air inlet port through the communication passage, and the first valve body is deformed from the opening position to the closing position so as to act as a partition between the inside of the inner cylinder and the inside of the spout cylinder.

As has been discussed, according to the present invention, a time lag occurs between a press to the double-walled container by a user and the discharge of the content fluid in the double-walled container from the spout. Thus, the user can obtain sufficient time to discharge the content fluid from the spout after pressing the double-walled container, thereby preventing rapid discharge of the content fluid from the spout.

Moreover, the user releases pressure on the double-walled container so as to change the first valve body from the opening position to the closing position. At this point, the first valve body is deformed from a convex shape expanding into the spout cylinder to a concave shape retracting into the inner cylinder. Thus, the level of a content fluid remaining in the spout cylinder is drawn into the spout cylinder according to a volume corresponding to the deformation amount of the first valve body. This can prevent the content fluid remaining in the spout cylinder from reaching the spout at the tip end of the spout cylinder.

According to the present invention, when the user releases pressure on the double-walled container, the amount of a content fluid remaining in the spout cylinder can be reduced.

DESCRIPTION OF THE EMBODIMENTS

Embodiments of the present invention will be described below with reference to the accompanying drawings.

First Embodiment

Figure 1:
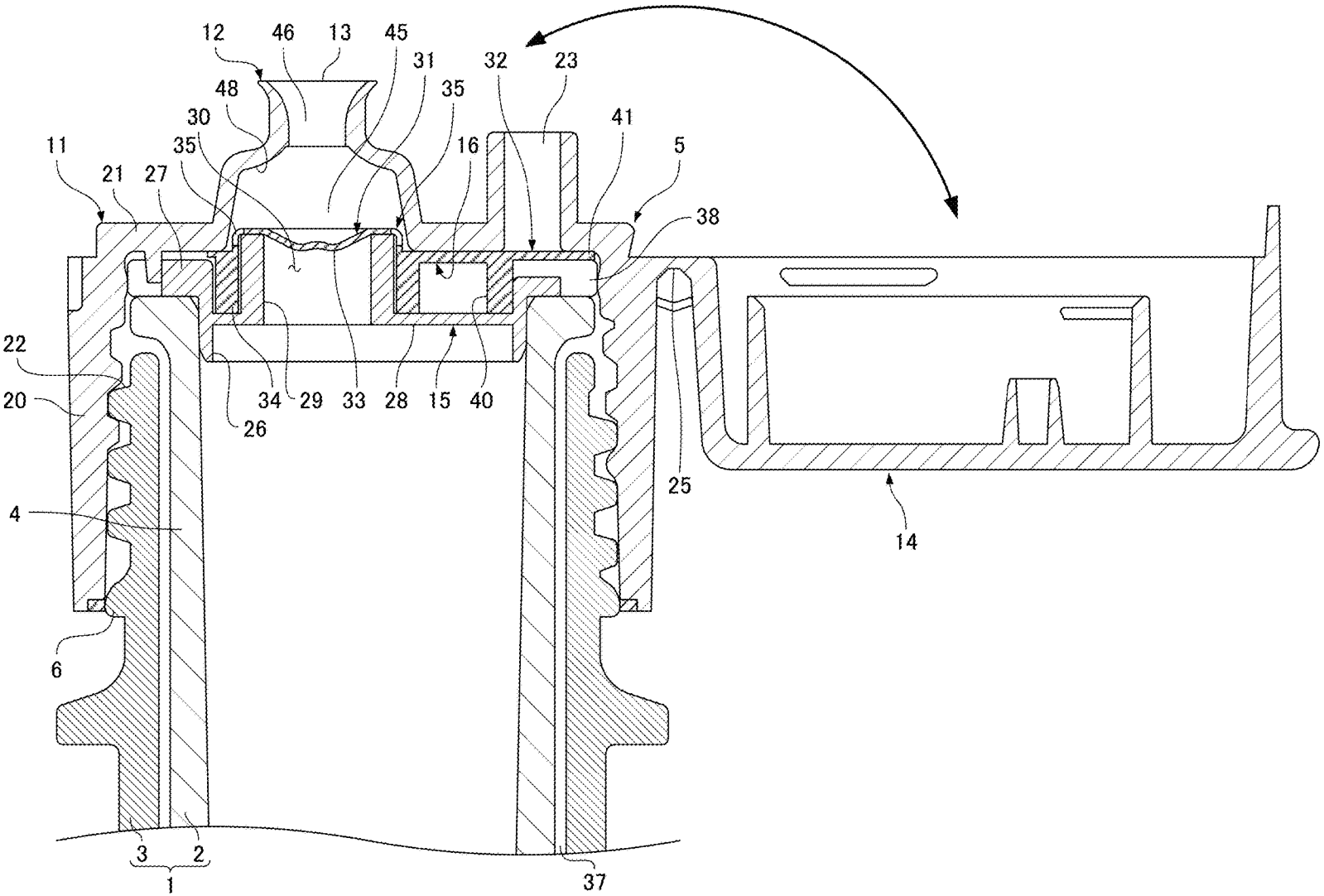
FIG. 1 is a cross-sectional view showing a cap according to a first embodiment of the present invention.
Figure 2:
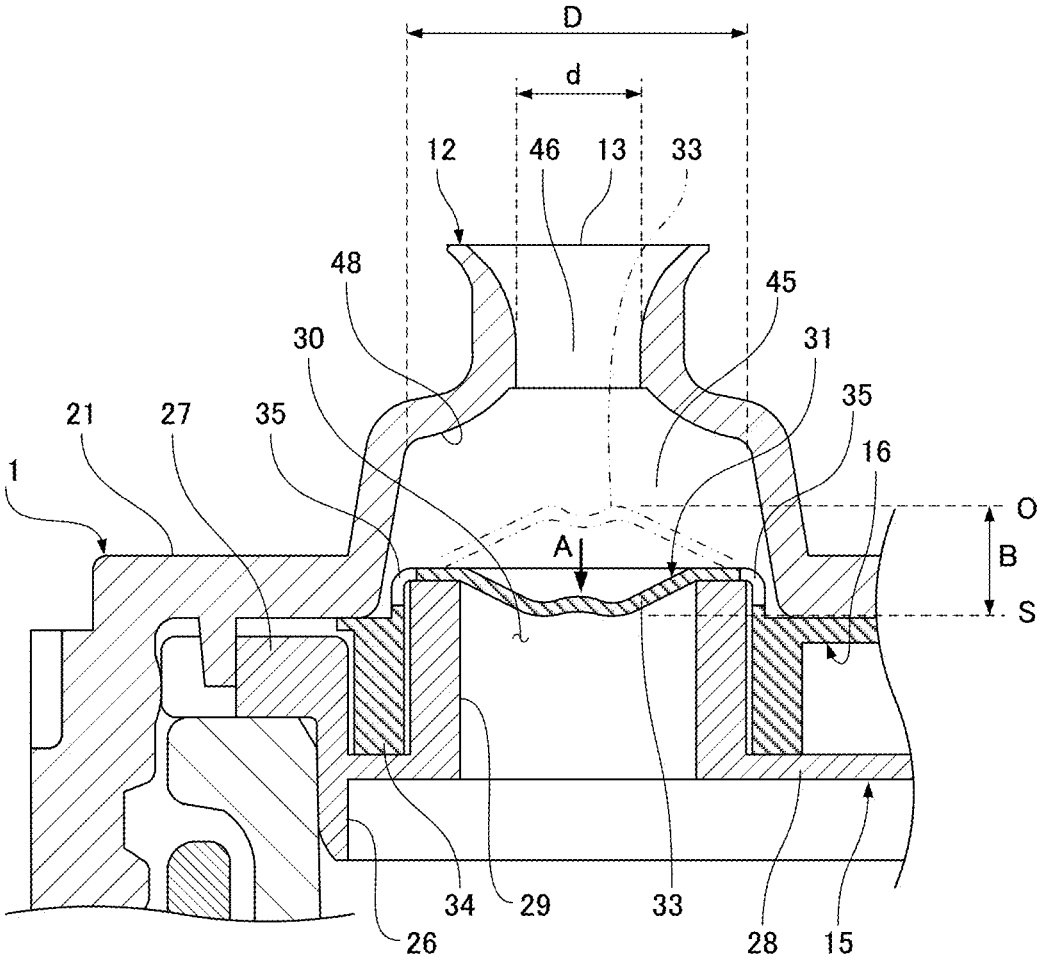
FIG. 2 is a partially enlarged cross-sectional view of the cap.
Figure 3:
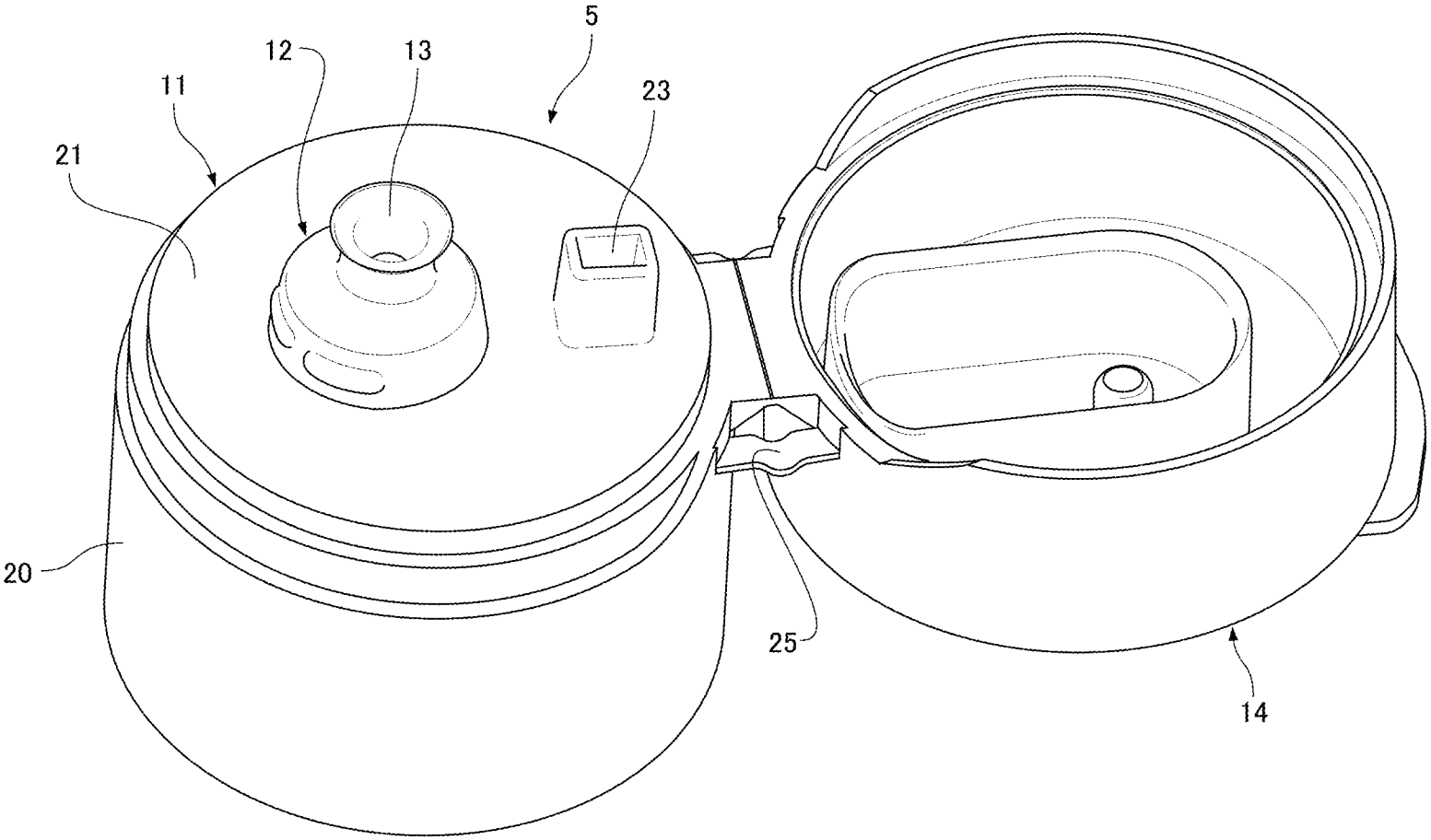
FIG. 3 is a perspective view of the cap.

In a first embodiment, as shown in FIGS. 1 to 3, reference numeral 1 denotes a double-walled container. The double-walled container 1 has an inner container 2 that can be deformed with flexibility and an outer container 3 that can be elastically deformed with flexibility. A cap 5 is provided on a mouth 4 of the double-walled container 1.

The cap 5 includes a main unit 11 fit onto the mouth 4, a circular spout cylinder 12 provided on the main unit 11, a lid 14 that opens and closes a spout 13 formed at the tip end of the spout cylinder 12, an inner stopper 15 that is provided in the main unit 11 so as to be fit into the mouth 4, and an inner valve device 16 provided in the main unit 11.

The main unit 11 includes a cylindrical body 20 and a circular top 21 provided at the end of the body 20. The body 20 is screwed onto the outer container 3 with a screw 22. The spout cylinder 12 is integrated with the top 21. Moreover, the top 21 has an air inlet port 23 that draws outside air into a clearance 37 between the inner container 2 and the outer container 3.

The main unit 11 contains a communication passage 38 that communicates with the air inlet port 23 and the clearance 37 between the inner container 2 and the outer container 3. The air inlet port 23 and the communication passage 38 are formed at a point in the circumferential direction of the main unit 11.

The outer container 3 has a sealing protrusion 6 that is formed around the outer container 3 so as to provide sealing between the inside of the body 20 of the main unit and the outer periphery of the mouth 4 of the outer container 3. The lid 14 is provided on the main unit 11 so as to open and close with a hinge 25.

Figure 4:
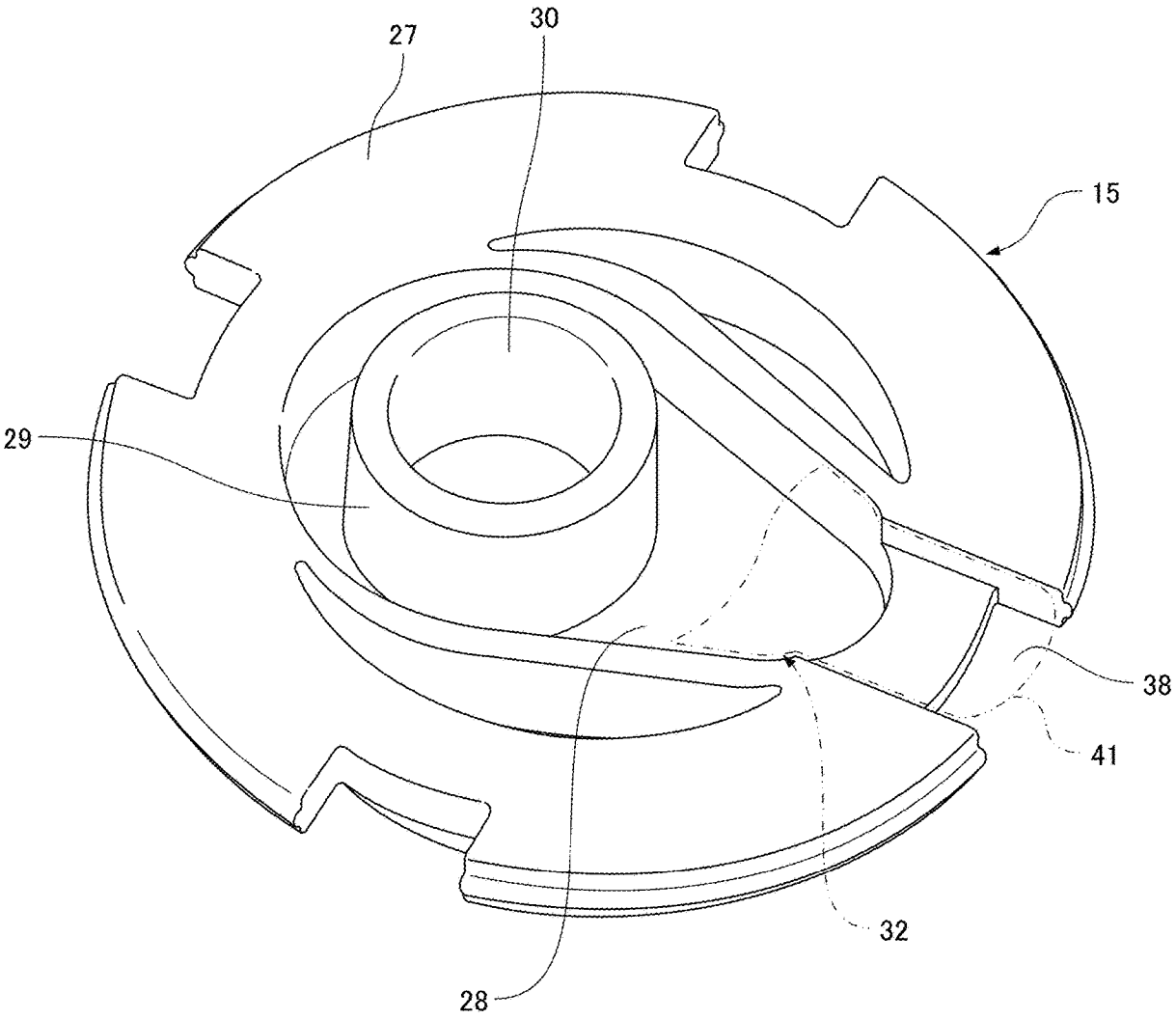
FIG. 4 is a perspective view of an inner stopper for the cap.
Figure 5:
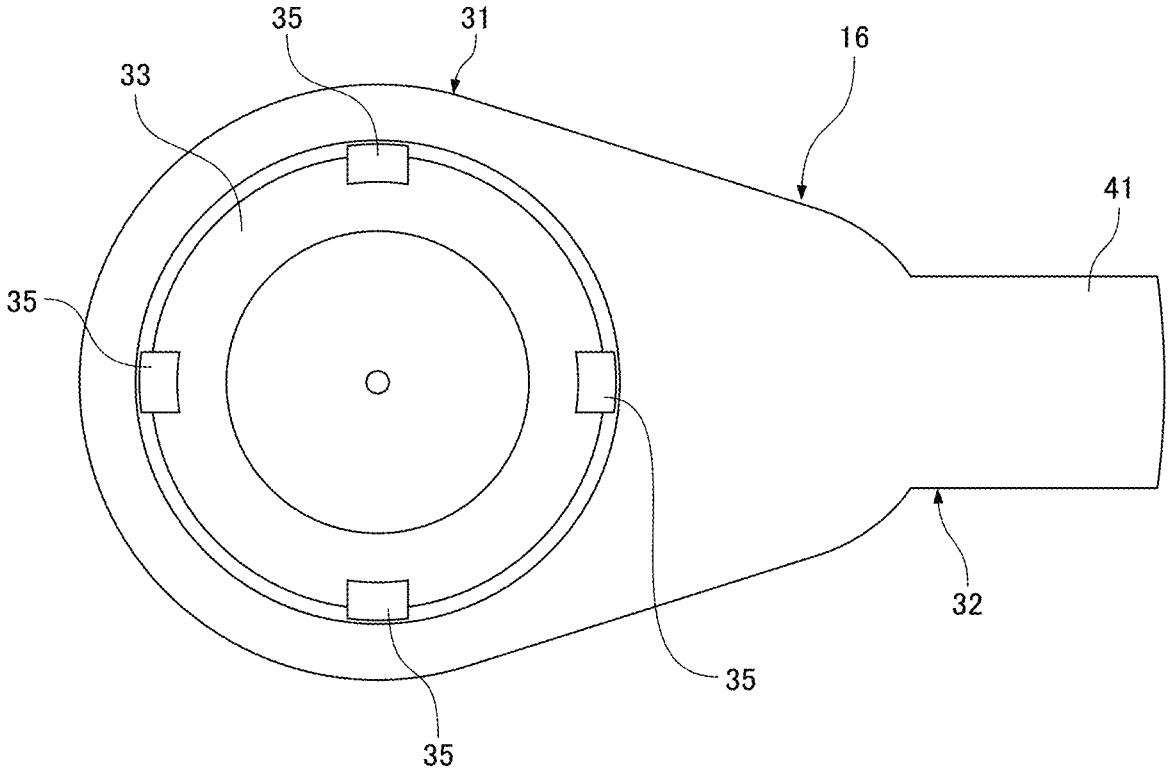
FIG. 5 is a plan view showing an inner valve device for the cap.
Figure 6:
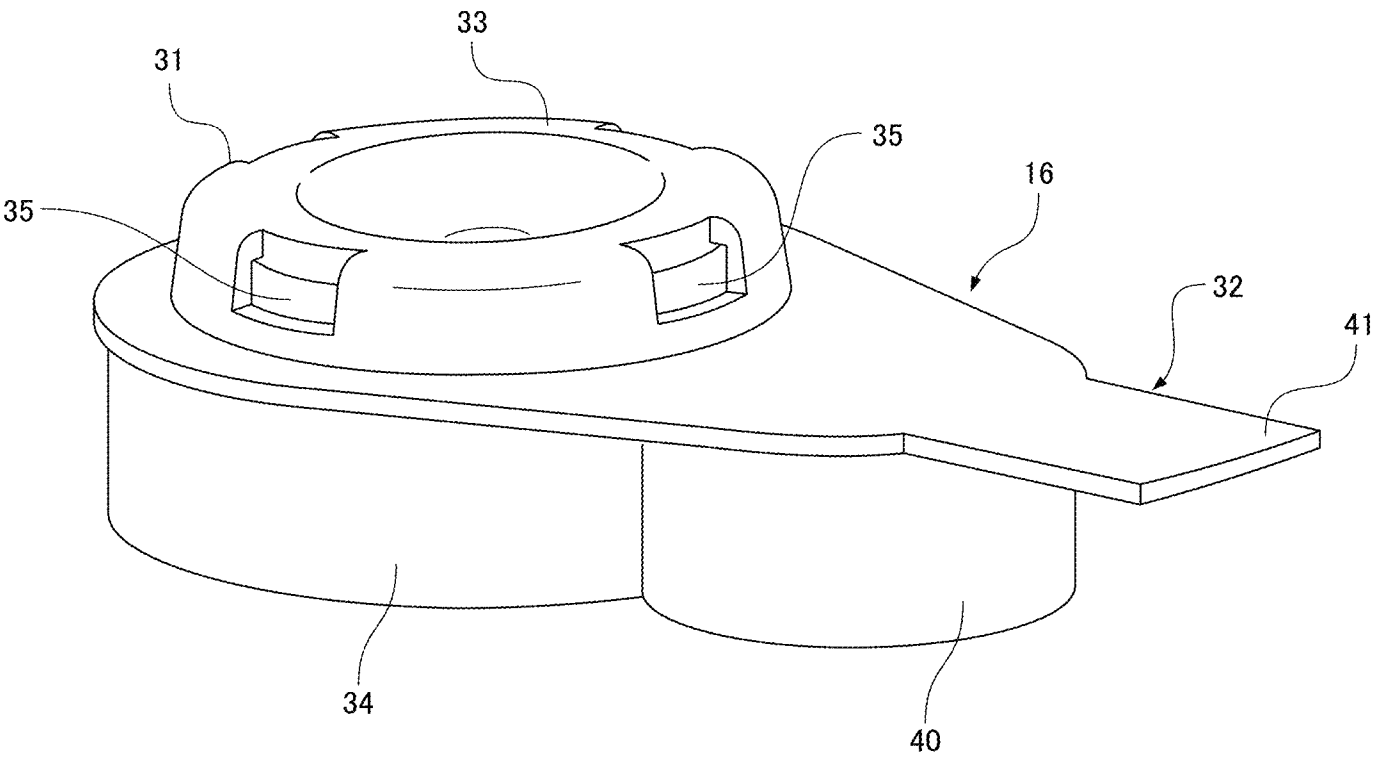
FIG. 6 is a perspective view from the top of the inner valve device for the cap.
Figure 7:
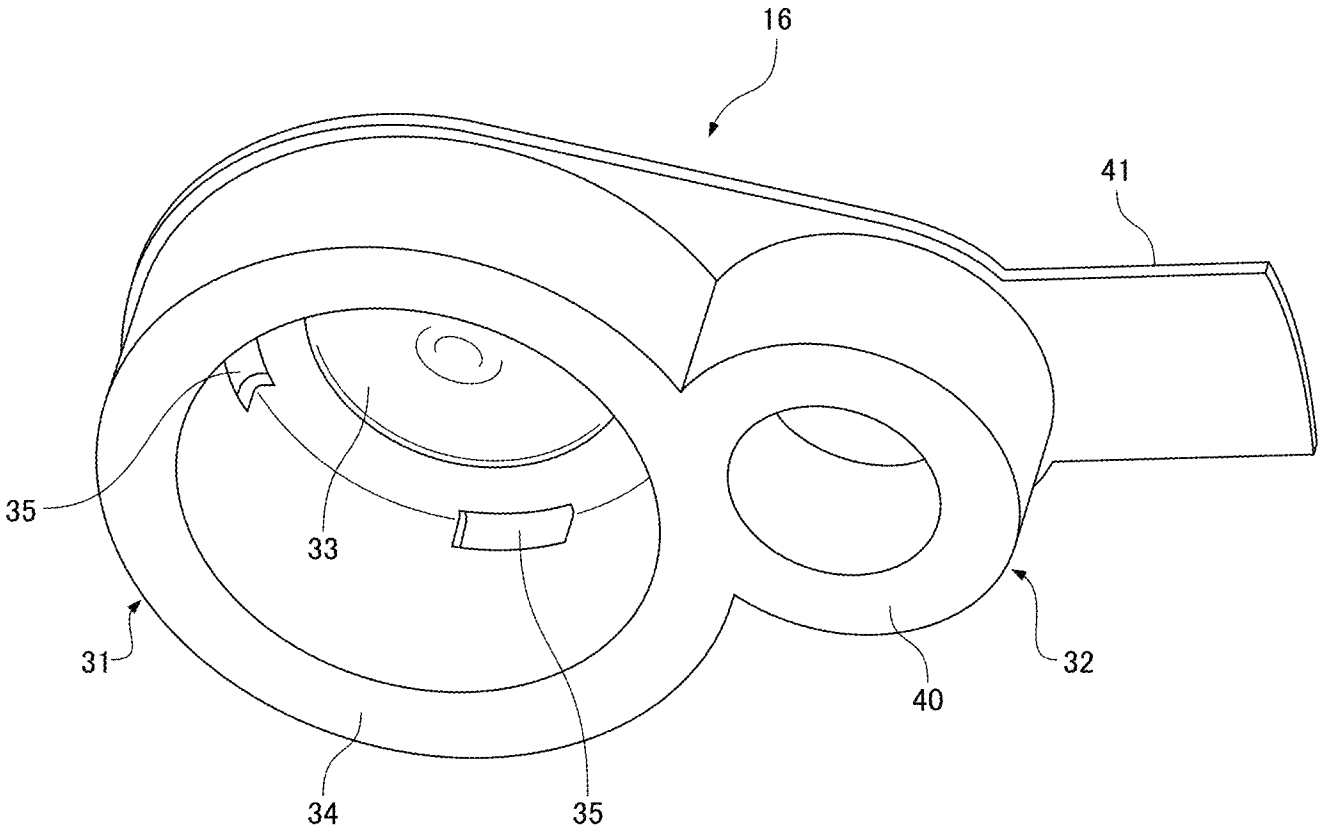
FIG. 7 is a perspective view from the bottom of the inner valve device for the cap.

As shown in FIGS. 1 and 4, the inner stopper 15 includes a cylindrical fit portion 26 that is fit into the end opening of the inner container 2, a flange 27 radially extends to the outside from one end of the fit portion 26, a circular inner plate 28 formed inside the fit portion 26, and an inner cylinder 29 raised on the inner plate 28.

The inner cylinder 29 is an example of a communicating part. One end (lower end) of the inner cylinder 29 communicates with the inside of the inner container 2 and the other end (upper end) of the inner cylinder 29 communicates with the inside of the spout cylinder 12.

As shown in FIGS. 1, 2, and 5 to 7, the inner valve device 16 is made of an elastic material, e.g., silicon rubber. The inner valve device 16 has a first inner valve 31 and a second inner valve 32. The first inner valve 31 is shaped like a letter M in cross section and includes a circular first valve body 33 that covers an other-end opening 30 of the inner cylinder 29 and a circular first support cylinder 34. The inner cylinder 29 is extended into the first support cylinder 34 from one end of the first support cylinder 34. The outer periphery of the first valve body 33 is integrated with the other end of the first support cylinder 34.

A plurality of passage holes 35 are formed on the circumference of the first valve body 33 facing the other end of the inner cylinder 29. The first valve body 33 can be deformed to a closing position S where the first valve body 33 retracts concavely into the inner cylinder 29 and an opening position O where the first valve body 33 expands convexly from the inside of the inner cylinder 29 into the spout cylinder 12. The first valve body 33 is biased in a closing direction A.

Figure 8:
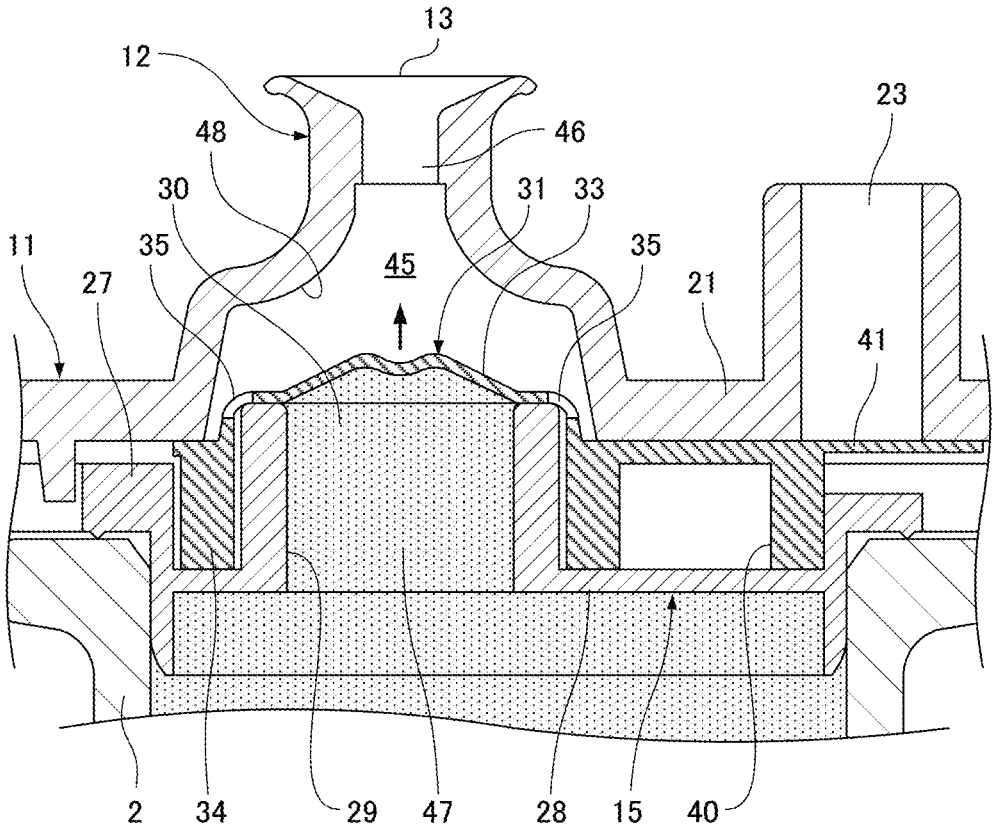
FIG. 8 is a cross-sectional view showing an operation of a first inner valve for the cap with a first valve body being deformed from a closing position toward an opening position.

As indicated by solid lines in FIGS. 1 and 2, the first valve body 33 at the closing position S acts as a partition between the inside of the inner cylinder 29 and the inside of the spout cylinder 12. As indicated by virtual lines in FIG. 2 and shown in FIG. 9, the first valve body 33 at the opening position O causes the inside of the inner cylinder 29 and the inside of the spout cylinder 12 to communicate with each other through the passage holes 35 of the first valve body 33. Furthermore, as shown in FIG. 8, the first valve body 33 being deformed from the closing position S toward the opening position O keeps acting as a partition between the inside of the inner cylinder 29 and the inside of the spout cylinder 12.

As shown in FIGS. 1 and 5 to 7, the second inner valve 32 is integrated with the first inner valve 31 and opens and closes the air inlet port 23. Furthermore, the second inner valve 32 includes a circular second support cylinder 40 (an example of a support member) fixed between the top 21 of the main unit 11 and the inner plate 28 of the inner stopper 15 and a second valve body 41 that is provided on the second support cylinder 40 so as to be elastically deformed.

Figure 13:
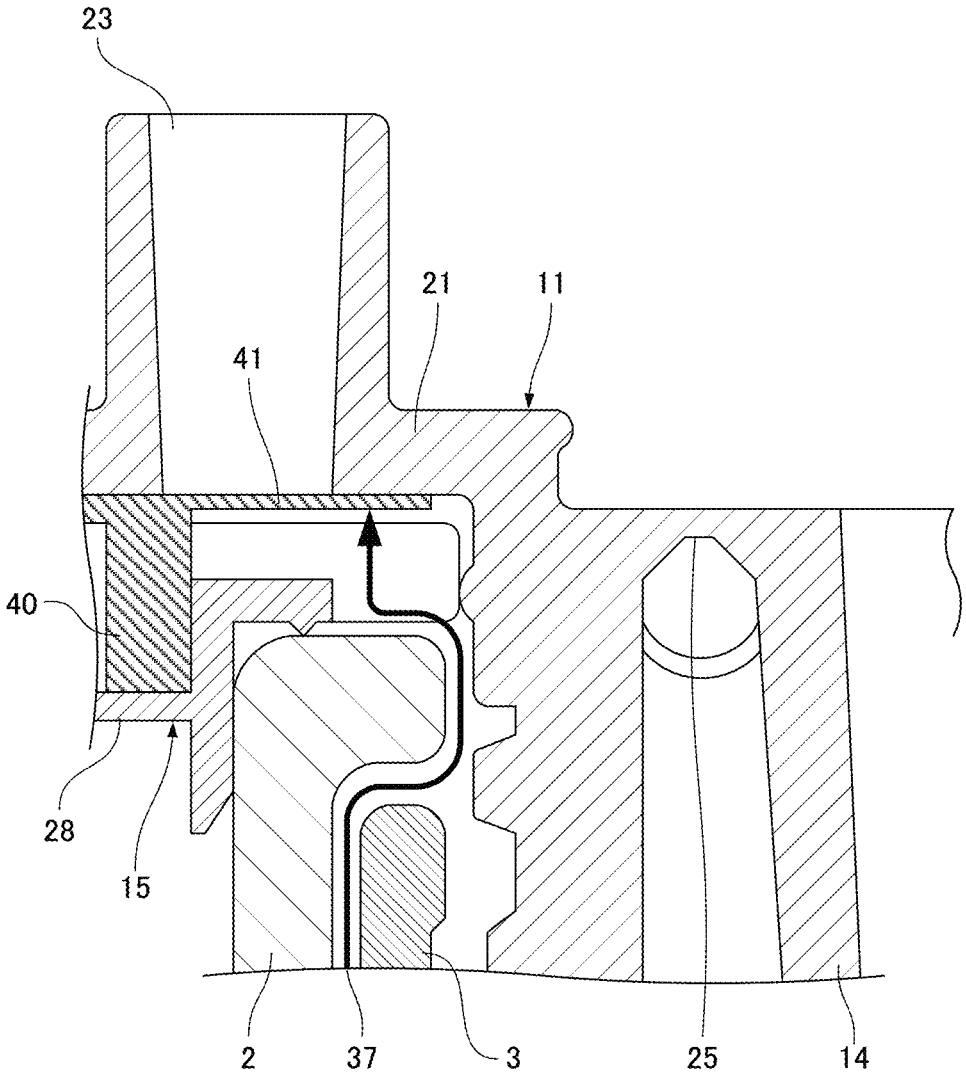
FIG. 13 is a cross-sectional view showing an operation of the second inner valve for the cap with the closed second valve body.
Figure 14:
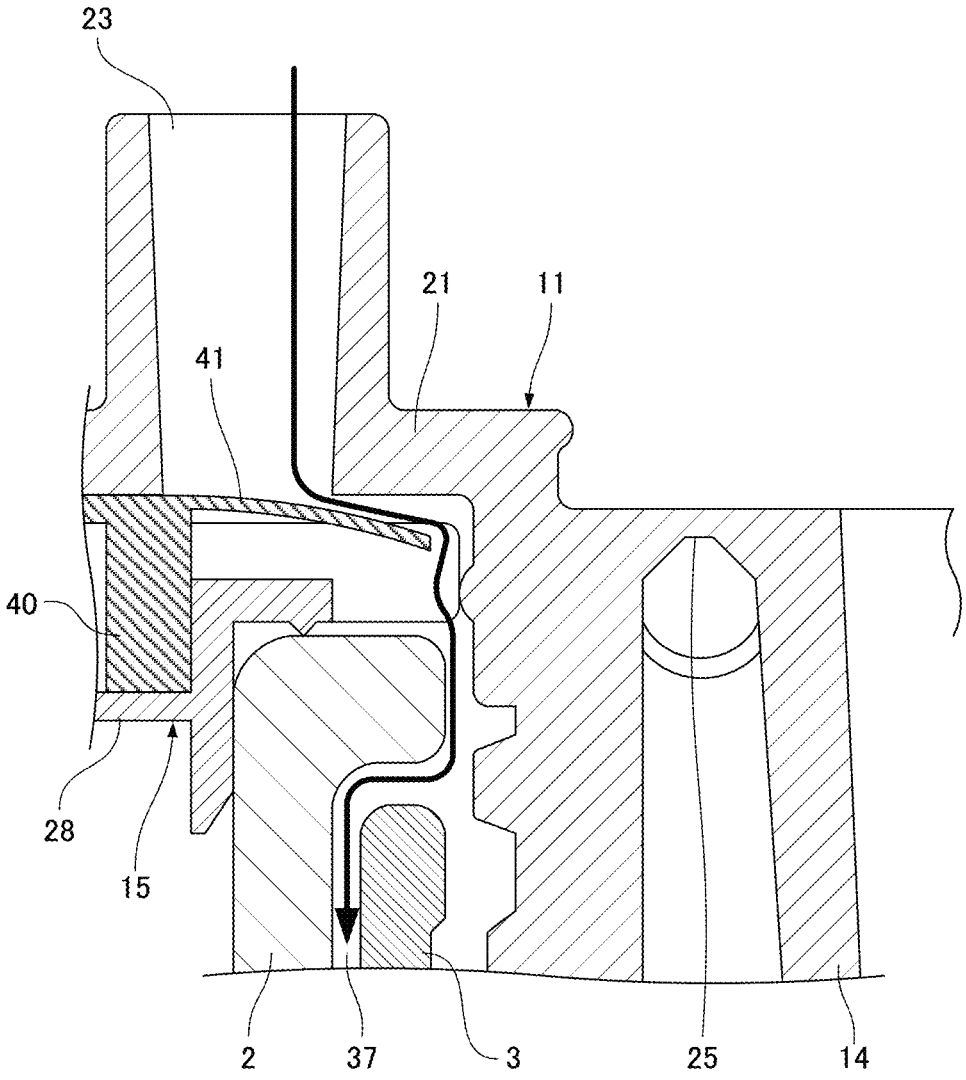
FIG. 14 is a cross-sectional view showing an operation of the second inner valve for the cap with the opened second valve body.

The second valve body 41 is a square thin plate whose proximal end is provided on the outer periphery of the second support cylinder 40. When the pressure of the clearance 37 between the inner container 2 and the outer container 3 exceeds an atmospheric pressure, as shown in FIG. 13, the free end of the second valve body 41 is pressed to the inner surface of the top 21 of the main unit 11 so as to close the air inlet port 23. When the pressure of the clearance 37 between the inner container 2 and the outer container 3 falls below an atmospheric pressure, as shown in FIG. 14, the free end of the second valve body 41 separates from the inner surface of the top 21 of the main unit 11 so as to open the air inlet port 23.

Figure 12:
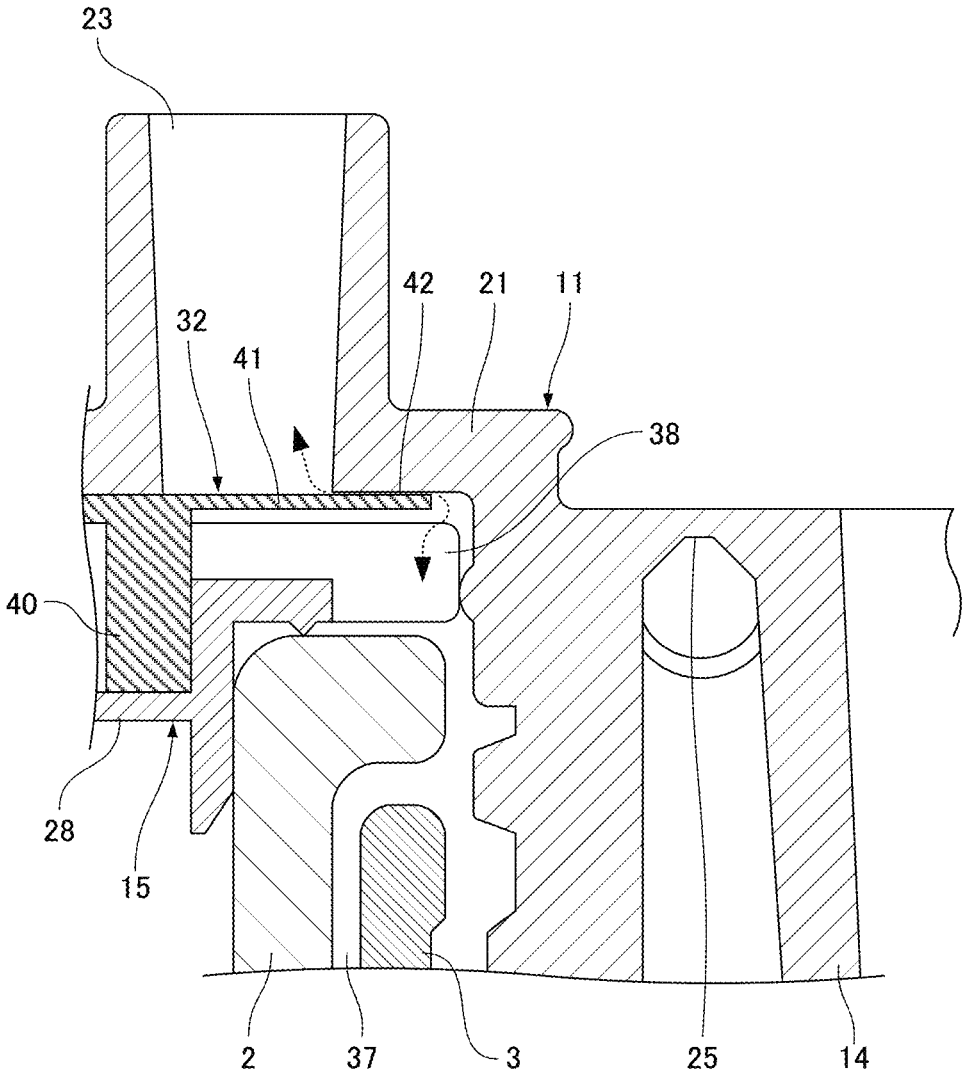
FIG. 12 is an enlarged cross-sectional view showing a second inner valve for the cap with a small clearance formed between a second valve body and a main unit.

When the pressure of the clearance 37 between the inner container 2 and the outer container 3 is equal to an atmospheric pressure, as shown in FIG. 12, the second valve body 41 does not fully close the air inlet port 23, forming a small clearance 42 between the free end of the second valve body 41 and the inner surface of the top 21 of the main unit 11. The air inlet port 23 and the communication passage 38 communicate with each other through the small clearance 42.

As shown in FIGS. 1 and 2, the spout cylinder 12 includes a storage part 45 that stores the first valve body 33 and a spout passage 46 that communicates with the spout 13 from the storage part 45. A diameter d of the spout passage 46 is smaller than a diameter D of the storage part 45.

A guide surface 48 shaped like an arc in cross section is formed in the spout cylinder 12 so as to guide a content fluid 47 into the spout passage 46 after the content fluid 47 flows into the storage part 45 in the spout cylinder from the inside of the inner cylinder 29 through the passage holes 35. Thus, the inside diameter of the spout cylinder 12 gradually decreases from the storage part 45 toward the spout passage 46.

The effect of the configuration will be described below.

As shown in FIG. 1, a user opens the lid 14 and presses (compresses) the double-walled container 1 with a hand so as to deform the outer container 3. When the pressure of the clearance 37 between the inner container 2 and the outer container 3 exceeds an atmospheric pressure, as shown in FIG. 13, the second valve body 41 is pressed to the inner surface of the top 21 of the main unit 11 to close the air inlet port 23. Thus, the internal pressure of the double-walled container 1 rises and the first valve body 33 is elastically deformed from the closing position S (solid lines in FIG. 2) where the first valve body 33 retracts concavely into the inner cylinder 29 to the opening position O (virtual lines in FIG. 2) where the first valve body 33 expands convexly into the spout cylinder 12. Thus, the inside of the inner cylinder 29 and the inside of the spout cylinder 12 communicate with each other through the passage holes 35 of the first valve body 33, so that the content fluid 47 in the inner container 2 flows into the spout cylinder 12 from the inside of the inner cylinder 29 through the passage holes 35 and then is discharged from the spout 13.

Figure 9:
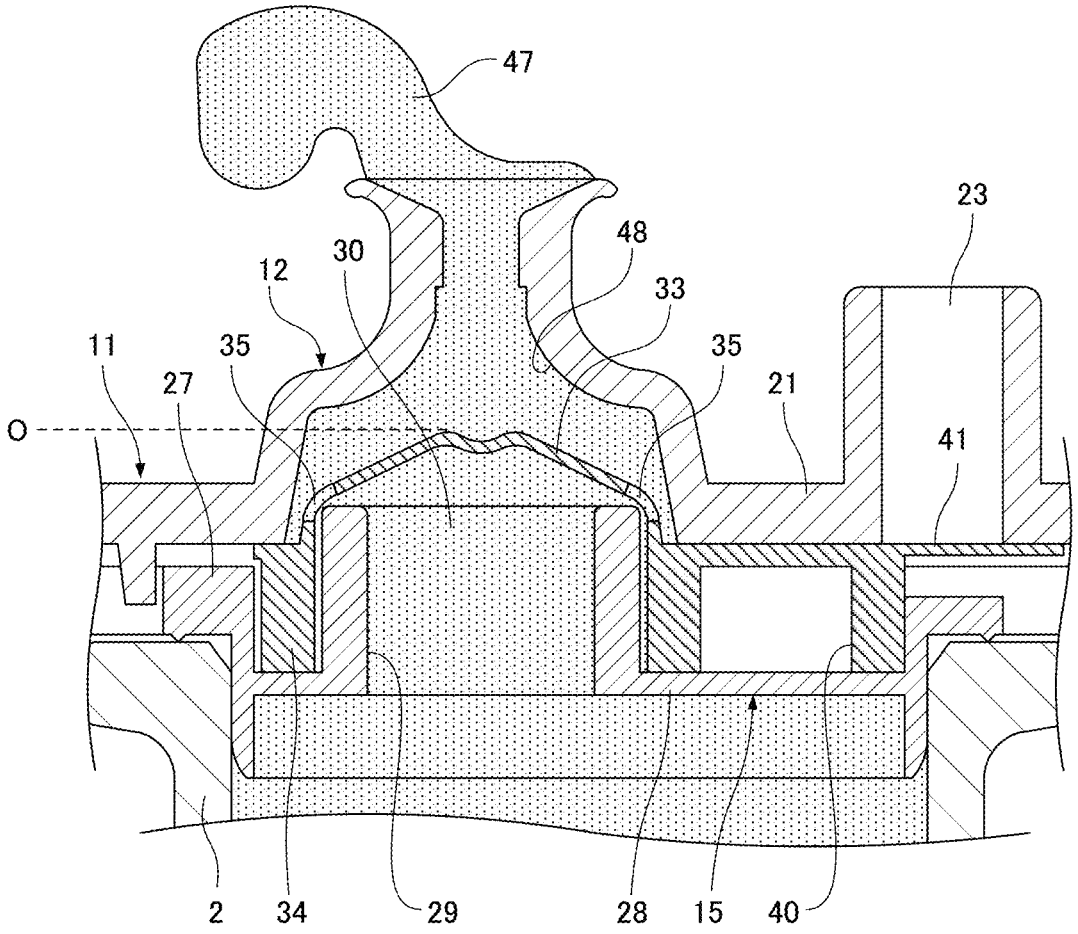
FIG. 9 is a cross-sectional view showing an operation of the first inner valve for the cap with the first valve body at the opening position.

At this point, as shown in FIG. 8, the first valve body 33 being deformed from the closing position S toward the opening position O keeps acting as a partition between the inside of the inner cylinder 29 and the inside of the spout cylinder 12. After that, as shown in FIG. 9, when the first valve body 33 reaches the opening position O, the inside of the inner cylinder 29 and the inside of the spout cylinder 12 communicate with each other through the passage holes 35. Thus, when the user presses the double-walled container 1, the inside of the inner cylinder 29 and the inside of the spout cylinder 12 communicate with each other through the passage holes 35 after a time required to deform the first valve body 33 from the closing position S to the opening position O.

This causes a time lag (delay) between a press to the double-walled container 1 by the user and the discharge of the content fluid 47 in the inner container 2 from the spout 13. Thus, the user can obtain sufficient time to discharge the content fluid 47 from the spout 13 after pressing the double-walled container 1, thereby preventing rapid discharge of the content fluid 47 from the spout 13.

At this point, the content fluid 47 in the inner container 2 flows into the storage part 45 in the spout cylinder 12 from the inside of the inner cylinder 29 through the passage holes 35. The content fluid 47 is then guided to the guide surface 48, is smoothly collected from the storage part 45 into the spout passage 46, and is discharged from the spout 13 through the spout passage 46. This radially discharges the content fluid 47 from the spout 13 without disturbing the flow of the content fluid 47 in the spout cylinder 12.

Figure 10:
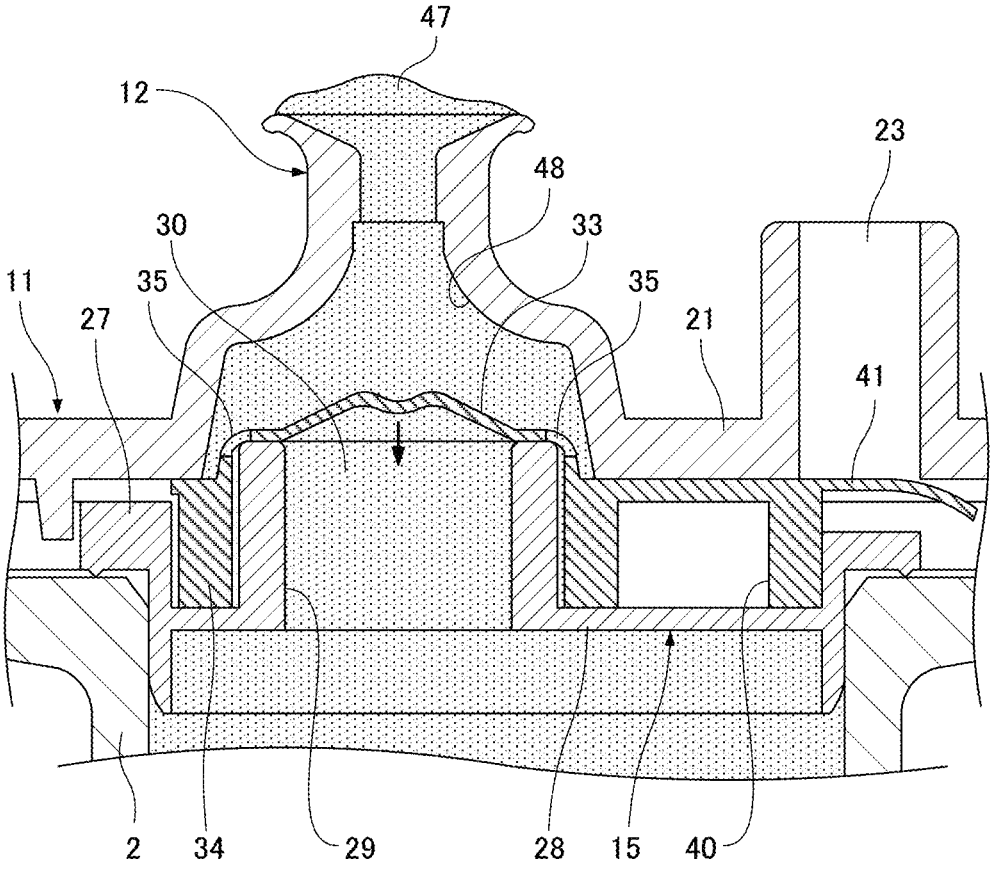
FIG. 10 is a cross-sectional view showing an operation of the first inner valve for the cap with the first valve body being deformed from the opening positon toward the closing position.
Figure 11:
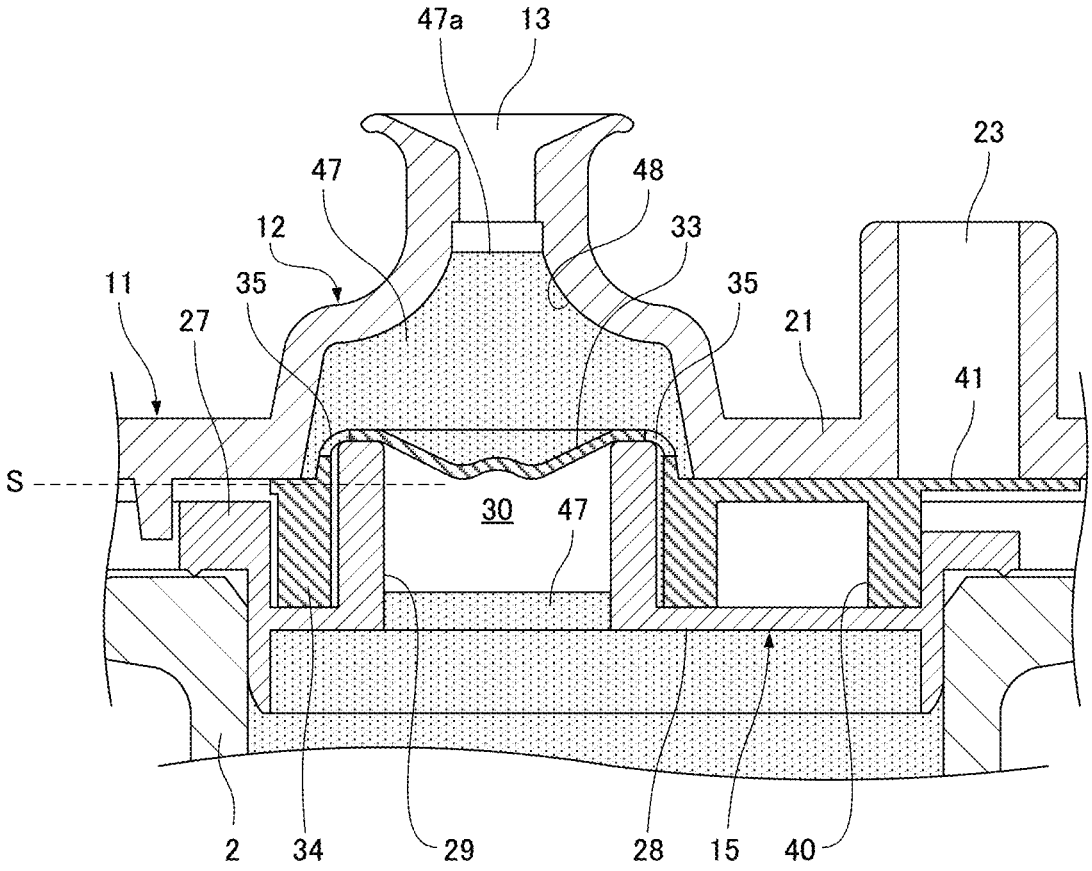
FIG. 11 is a cross-sectional view showing an operation of the first inner valve for the cap with the first valve body returned from the opening position to the closing position.

The user releases pressure on the double-walled container 1 to restore the outer container 3 to an original shape obtained before the press to the double-walled container 1. Moreover, the pressure of the clearance 37 between the inner container 2 and the outer container 3 falls below an atmospheric pressure. At this point, as shown in FIG. 14, the second valve body 41 is separated from the inner surface of the top 21 of the main unit 11 so as to open the air inlet port 23. Thus, air is fed to the clearance 37 between the inner container 2 and the outer container 3 from the air inlet port 23 through the communication passage 38. Hence, as shown in FIGS. 10 and 11, the first valve body 33 is deformed from the opening position O where the first valve body 33 expands convexly into the spout cylinder 12 to the closing position S where the first valve body 33 retracts concavely into the inner cylinder 29, so that the first valve body 33 acts as a partition between the inside of the inner cylinder 29 and the inside of the spout cylinder 12.

In this way, the first valve body 33 being closed is considerably deformed from a convex shape to a concave shape in a vertical direction. Thus, as shown in FIG. 11, a level 47*a* of the content fluid 47 remaining in the spout cylinder 12 is drawn (lowered) into the spout cylinder 12 according to a volume corresponding to a deformation amount B (see FIG. 2) of the first valve body 33. Such a suction effect can prevent the content fluid 47 remaining in the spout cylinder 12 from reaching the spout 13 of the spout cylinder 12.

The air inlet port 23 and the communication passage 38 are formed at a point in the circumferential direction of the main unit 11, the proximal end of the second valve body 41 is provided on the second support cylinder 40, and the free end of the second valve body 41 can be pressed to or separated from the inner surface of the main unit 11. With this structure, the second valve body 41 can sensitively react with a pressure change of the clearance 37 between the inner container 2 and the outer container 3 so as to quickly open or close the air inlet port 23.

Under normal conditions where a user does not press the double-walled container 1 and the outer container 3 is not deformed (including the state where the user releases pressure on the double-walled container 1 to restore the outer container 3 to the original shape obtained before the press), as shown in FIG. 12, the air inlet port 23 and the communication passage 38 communicate with each other through the small clearance 42. For example, if the double-walled container 1 reaches a higher temperature than outside air and air thermally expands in the clearance 37 between the inner container 2 and the outer container 3, the thermally expanding air flows into the air inlet port 23 from the communication passage 38 through the small clearance 42 and then is discharged from the air inlet port 23. Thus, under the normal conditions, an internal pressure of the double-walled container 1 and an external pressure are balanced through the small clearance 42. This can prevent air in the clearance 37 between the inner container 2 and the outer container 3 from thermally expanding so as to raise a pressure in the double-walled container 1, thereby preventing the level of the content fluid 47 in the double-walled container 1 from rising without a press to the double-walled container 1 by a user.

Second Embodiment

Figure 15:
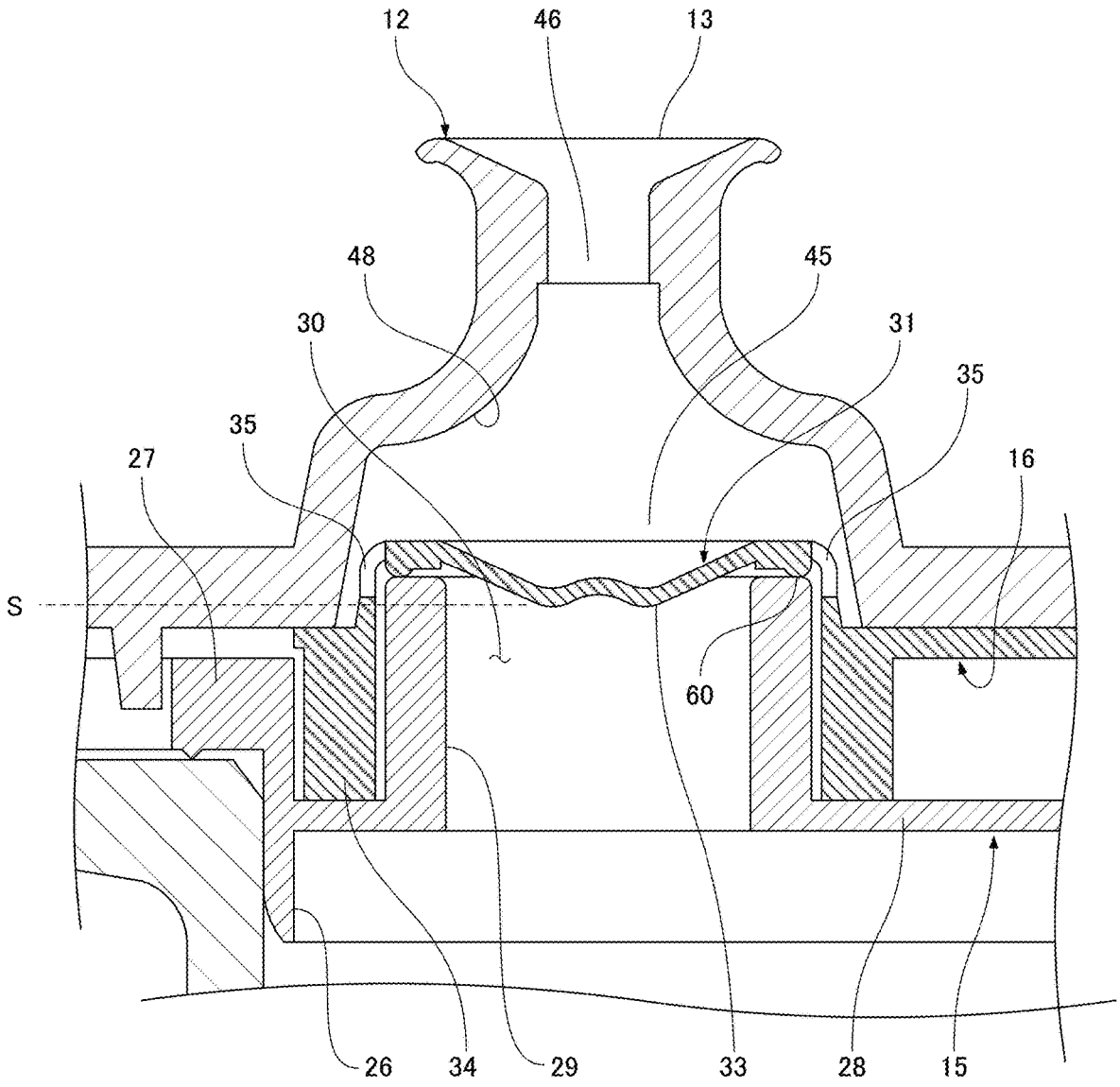
FIG. 15 is a partially enlarged cross-sectional view showing a cap according to a second embodiment of the present invention with a first inner valve including a first valve body at a closing position.

In a second embodiment, as shown in FIG. 15, a first valve body 33 has an annular protrusion 60 circumferentially pressed to the other end of an inner cylinder 29 at a closing position S. The passage holes 35 are located outside the protrusion 60 in a radial direction of the first valve body 33.

Figure 16:
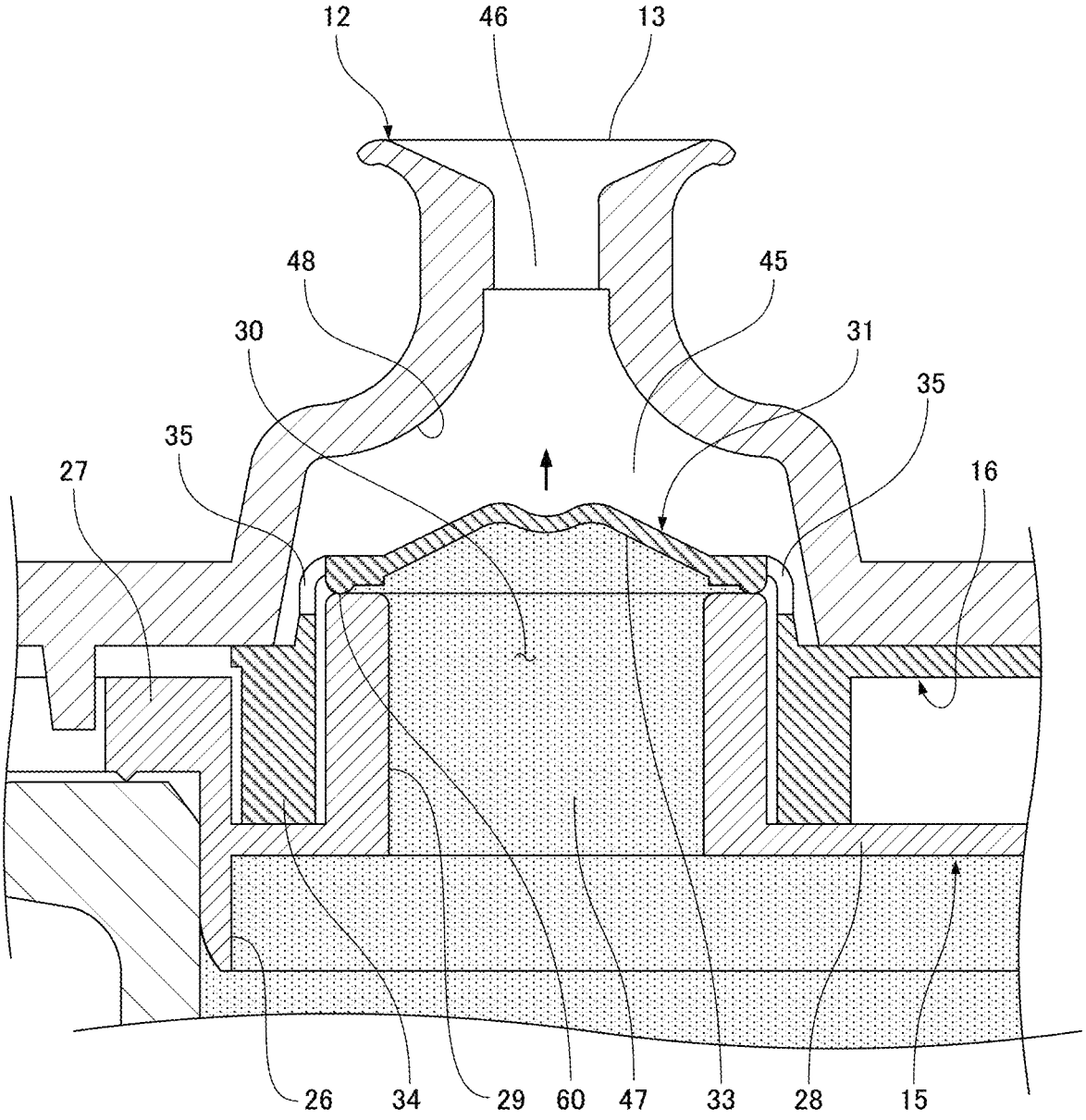
FIG. 16 is a cross-sectional view showing an operation of the first inner valve for the cap with the first valve body being deformed from the closing position toward an opening position.
Figure 17:
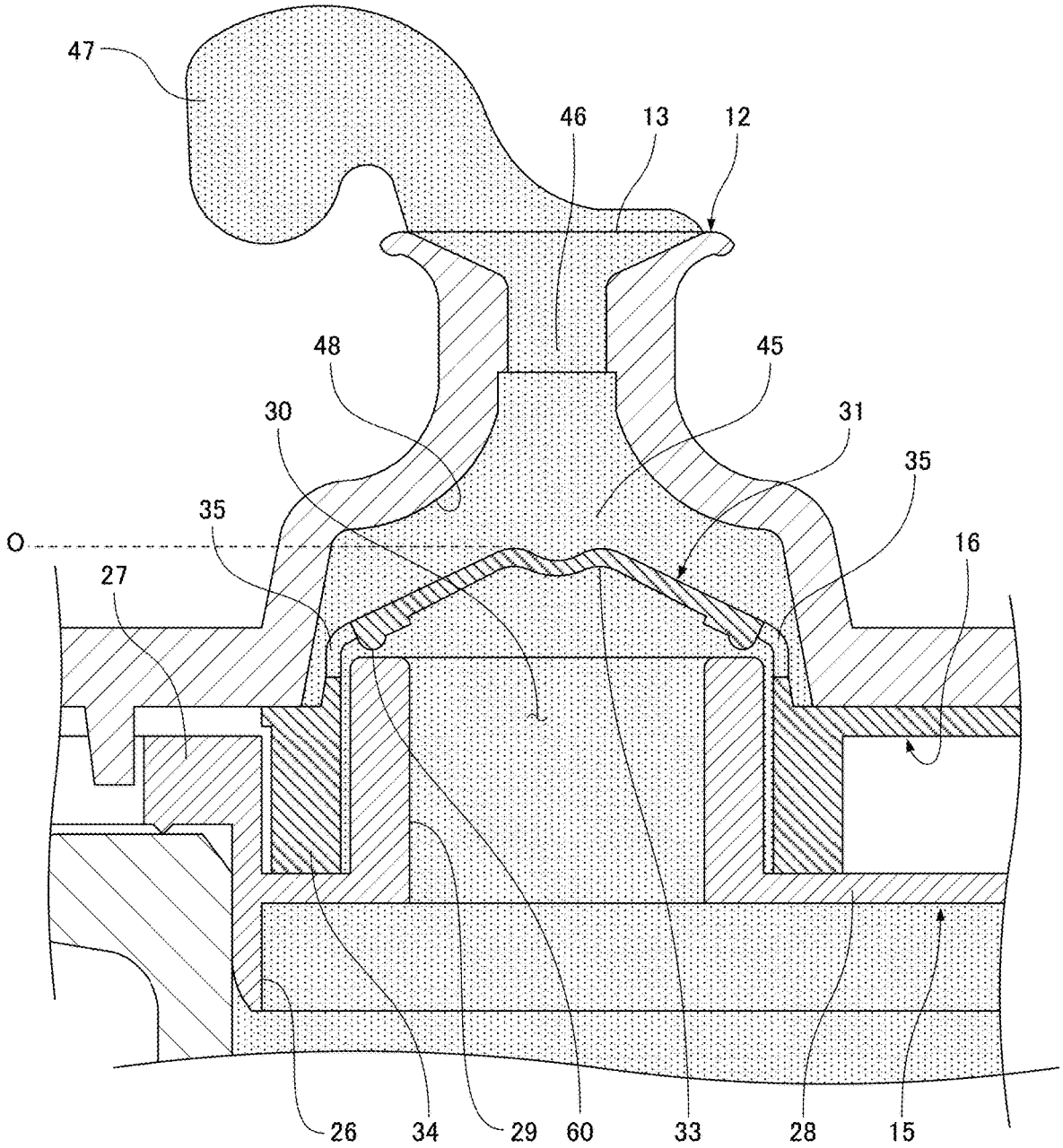
FIG. 17 is a cross-sectional view showing an operation of the first inner valve for the cap with the first valve body at the opening position.

When the first valve body 33 is deformed to the closing position S, the protrusion 60 is pressed to the other end of the inner cylinder 29, causing the first valve body 33 to act as a partition between the inside of the inner cylinder 29 and the inside of a spout cylinder 12. As shown in FIG. 17, when the first valve body 33 is deformed to an opening position O, the protrusion 60 separates from the other end of the inner cylinder 29, causing the inside of the inner cylinder 29 and the inside of the spout cylinder 12 to communicate with each other through the passage holes 35 of the first valve body 33. Moreover, as shown in FIG. 16, when the first valve body 33 is being deformed from the closing position S to the opening position O, the protrusion 60 is pressed to the other end of the inner cylinder 29, causing the first valve body 33 to keep acting as a partition between the inside of the inner cylinder 29 and the inside of the spout cylinder 12.

The function of the configuration will be described below.

When a user opens a lid 14 and then presses a double-walled container 1 with a hand, the first valve body 33 is deformed from the closing position S (see FIG. 15) to the opening position O (see FIG. 17). During the deformation, as shown in FIG. 16, the protrusion 60 is pressed to the other end of the inner cylinder 29, causing the first valve body 33 to keep acting as a partition between the inside of the inner cylinder 29 and the inside of the spout cylinder 12. After that, as shown in FIG. 17, when the first valve body 33 reaches the opening position O, the protrusion 60 separates from the other end of the inner cylinder 29, causing the inside of the inner cylinder 29 and the inside of the spout cylinder 12 to communicate with each other through the passage holes 35 of the first valve body 33. Thus, when a user presses the double-walled container 1 with a hand, the inside of the inner cylinder 29 and the inside of the spout cylinder 12 communicate with each other through the passage holes 35 after a time required to deform the first valve body 33 from the closing position S to the opening position O. This causes a time lag (delay) between a press to the double-walled container 1 by the user and the discharge of a content fluid 47 in the inner container 2 from the spout 13. Thus, the user can obtain sufficient time to discharge the content fluid 47 from the spout 13 after pressing the double-walled container 1, thereby preventing rapid discharge of the fluid 47 from the spout 13.

The user releases pressure on the double-walled container 1 so as to deform the first valve body 33 from the opening position O to the closing position S. As shown in FIG. 15, the protrusion 60 is pressed to the other end of the inner cylinder 29, causing the first valve body 33 to act as a partition between the inside of the inner cylinder 29 and the inside of the spout cylinder 12. This can firmly seal a clearance between the first valve body 33 and the other end of the inner cylinder 29, thereby reliably preventing air in the spout cylinder 12 from entering the inner container 2 from the clearance between the first valve body 33 and the other end of the inner cylinder 29.

As shown in FIG. 15, at the closing position S, the protrusion 60 is pressed substantially in line contact with the other end of the inner cylinder 29. This can increase a contact force per unit area and sealing performance, thereby providing sufficient shielding capability for the first valve body 33. Furthermore, this can reduce a pressure required to press the double-walled container 1 by the user so as to deform the first valve body 33 from the closing position S to the opening position O.

Third Embodiment

Figure 18:
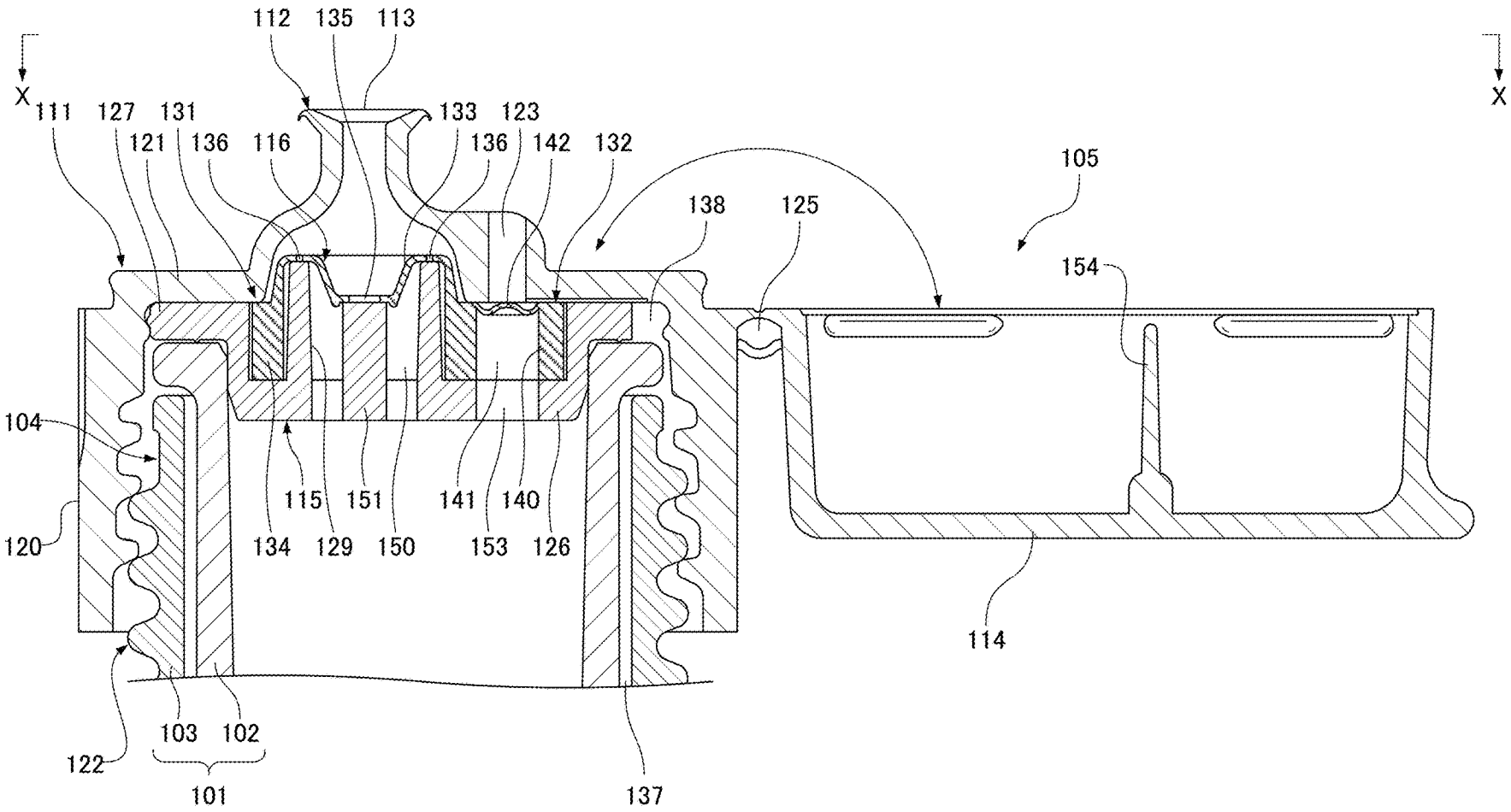
FIG. 18 is a cross-sectional view showing a cap according to a third embodiment of the present invention.
Figure 19:
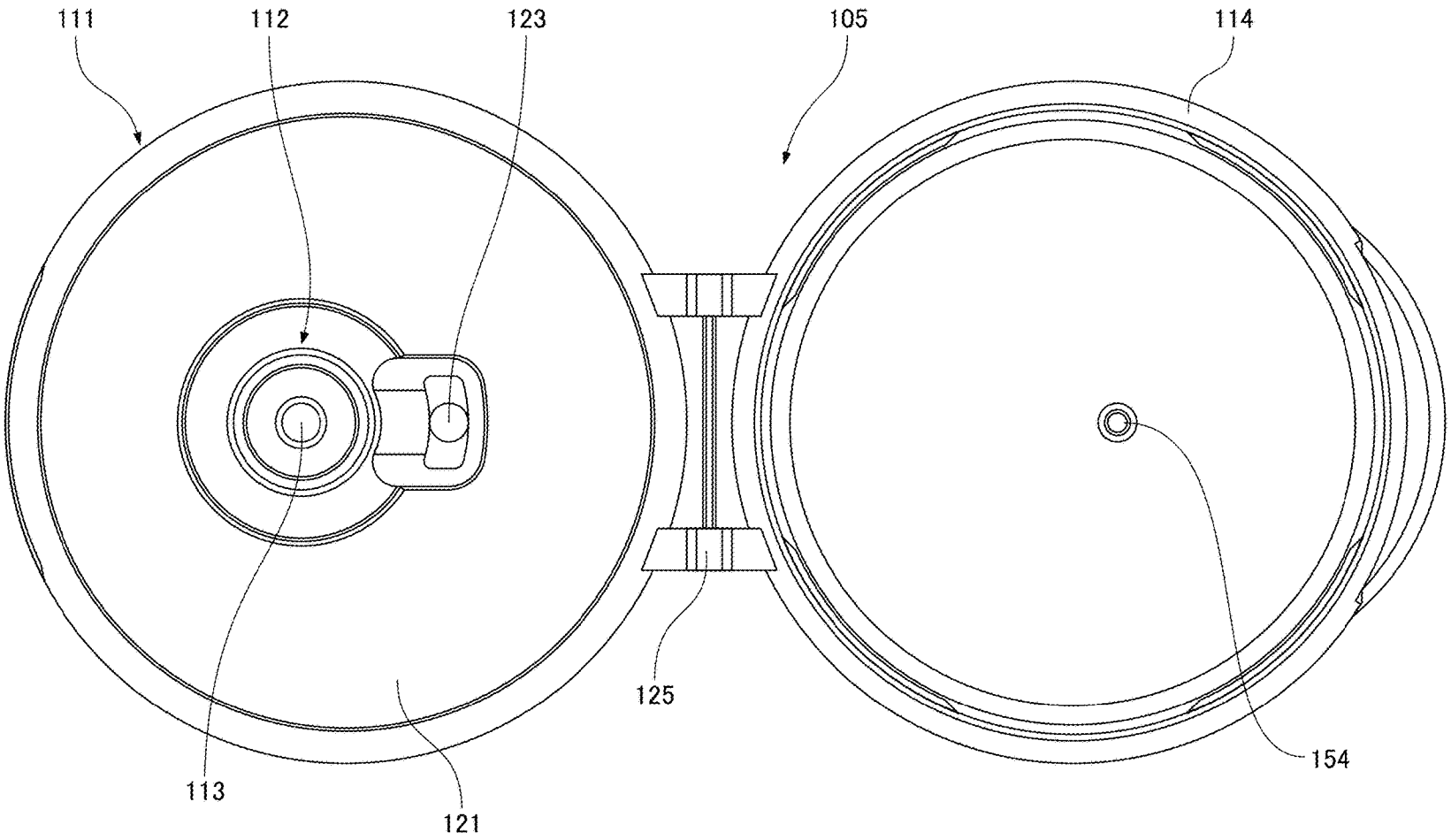
FIG. 19 is a cross-sectional view taken along line X-X of FIG. 18.
Figure 20:
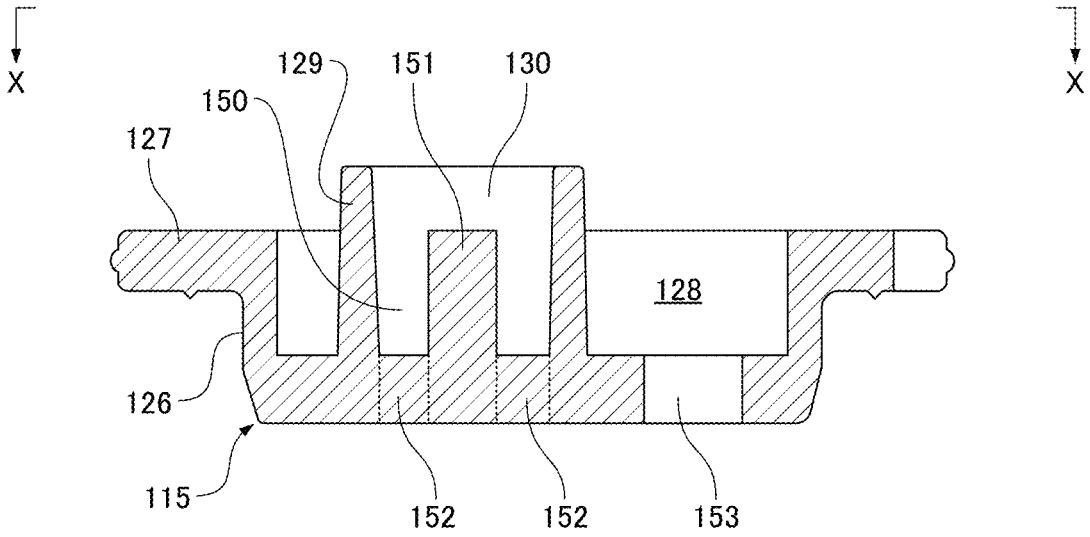
FIG. 20 is an enlarged cross-sectional view showing an inner stopper for the cap.
Figure 21:
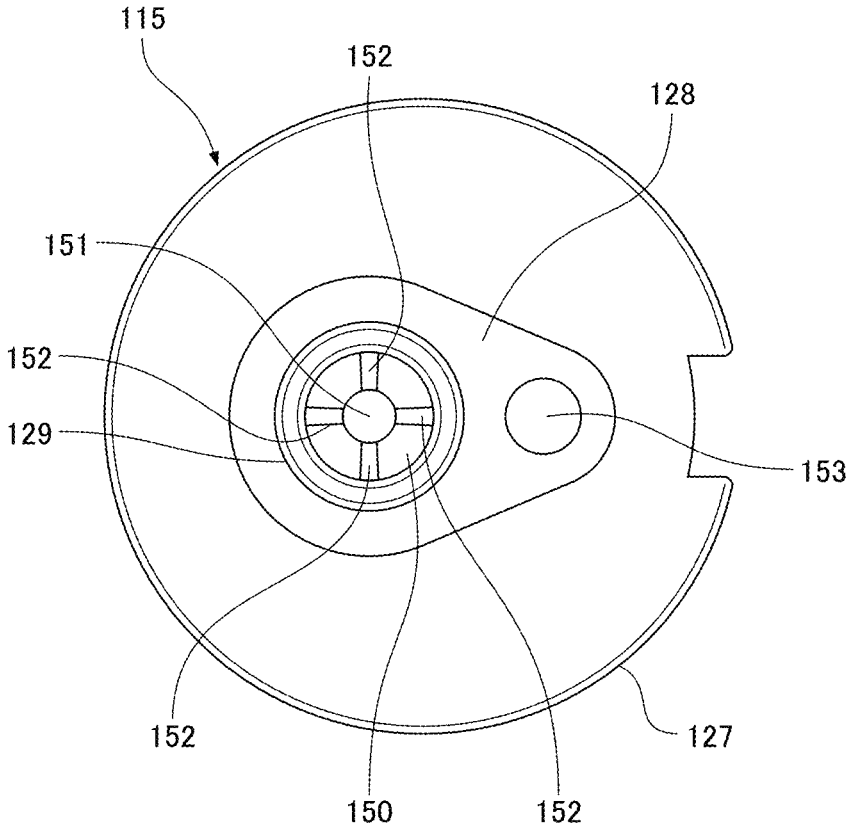
FIG. 21 is a cross-sectional view taken along line X-X of FIG. 20.
Figure 22:
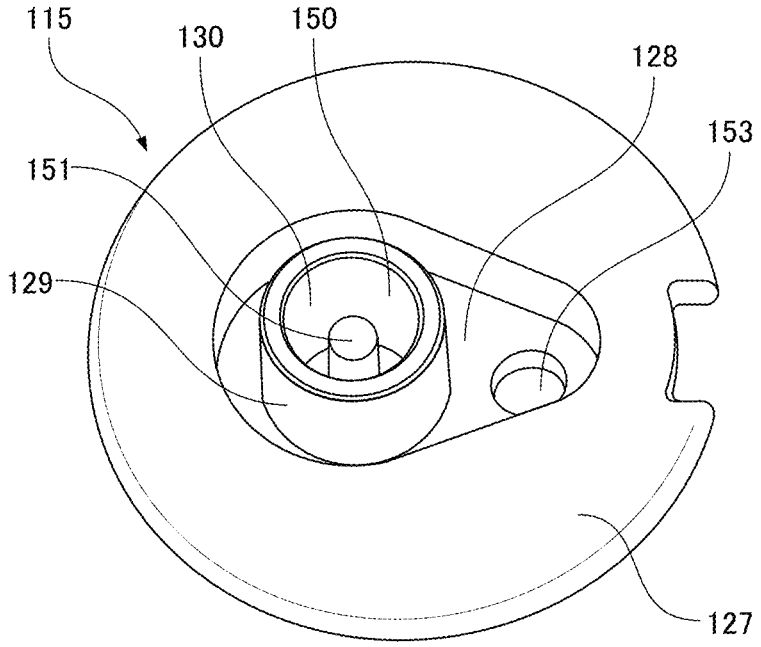
FIG. 22 is an enlarged perspective view showing the inner stopper for the cap.

In a third embodiment, as shown in FIGS. 18 and 19, reference numeral 101 denotes a double-walled container. The double-walled container 101 includes an inner container 102 that can be deformed with flexibility and an outer container 103 that can be elastically deformed with flexibility. A cap 105 is provided on a mouth 104 of the double-walled container 101.

The cap 105 includes a main unit 111 fit onto the mouth 104, a cylindrical spout cylinder 112 provided on the main unit 111, a lid 114 that opens and closes a spout 113 formed at the tip end of the spout cylinder 112, an inner stopper 115 that is provided in the main unit 111 so as to be fit into the mouth 104, and an inner valve device 116 provided in the main unit 111.

The main unit 111 includes a cylindrical body 120 and a circular top 121 provided at the end of the body 120. The body 120 is screwed onto an outer container 103 with a screw 122. The spout cylinder 112 is integrated with the top 121. The top 121 has an air inlet port 123 that draws outside air into a clearance 137 between the inner container 102 and the outer container 103.

The main unit 111 contains a communication passage 138 that communicates with the air inlet port 123 and the clearance 137 between the inner container 102 and the outer container 103.

The lid 114 is provided on the main unit 111 so as to open and close with a hinge 125, and contains a protrusion 154. When the lid 114 is closed, the protrusion 154 is inserted into the spout cylinder 112 from the spout 113, thereby sealing the spout cylinder 112.

As shown in FIGS. 18 and 20 to 22, the inner stopper 115 includes a circular fit portion 126 that is fit into the end opening of the inner container 102, a flange 127 that radially extends to the outside from one end of the fit portion 126, a depressed part 128 that is formed into a concave shape on the top surface of the fit portion 126, and an inner cylinder 129 raised in the depressed part 128. The inner cylinder 129 contains a communicating path 150 and a closing member 151. One end (lower end) of the communicating path 150 communicates with the inside of the inner container 102 and the other end (upper end) of the communicating path 150 communicates with the inside of the spout cylinder 112.

The closing member 151 is a rod member disposed at the center of the interior of the inner cylinder 129. The closing member 151 is attached to the inner cylinder 129 with a plurality of mounting plates 152 spaced every 90°. The four mounting plates 152 are provided in FIG. 21. The number of mounting plates 152 is not limited to four.

Figure 23:
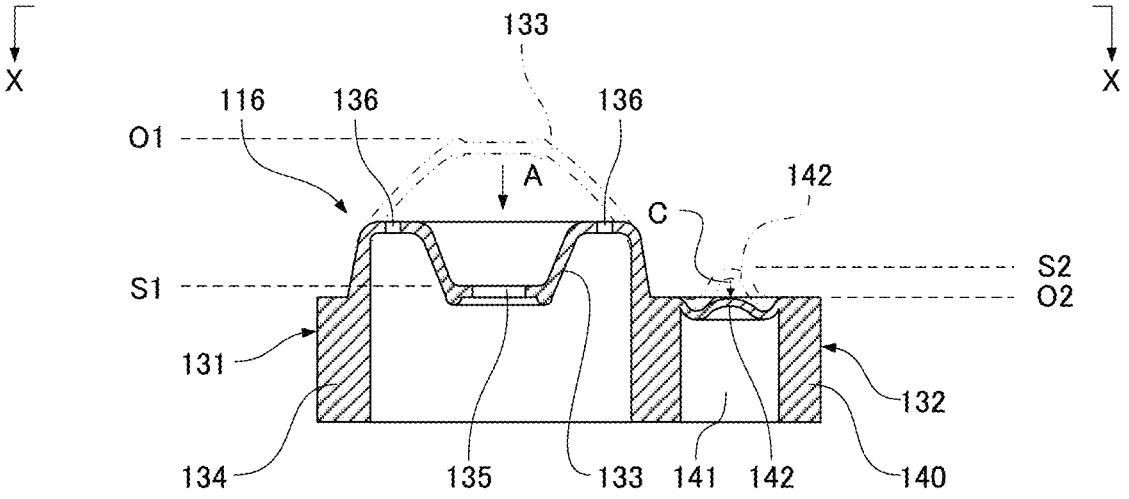
FIG. 23 is an enlarged cross-sectional view showing an inner valve device for the cap.
Figure 24:
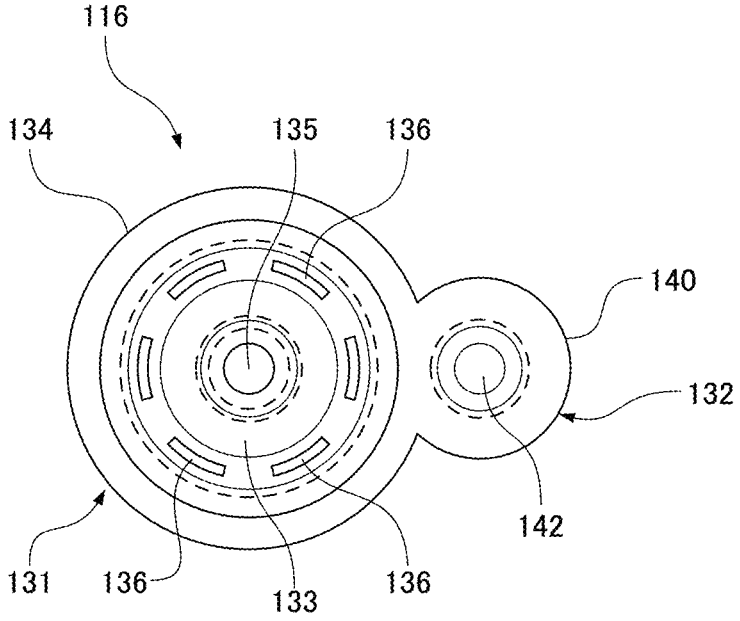
FIG. 24 is a cross-sectional view taken along line X-X of FIG. 23.

As shown in FIGS. 18, 23, and 24, the inner valve device 116 is made of an elastic material, e.g., silicon rubber. The inner valve device 116 has a first inner valve 131 and a second inner valve 132. The first inner valve 131 is shaped like a letter M in cross section and includes a circular thin first valve body 133 that covers an other-end opening 130 (see FIG. 20) of the inner cylinder 129, and a circular first support cylinder 134. The inner cylinder 129 is extended into the first support cylinder 134 from one end of the first support cylinder 134. The outer circumference of the first valve body 133 is integrated with the other end of the first support cylinder 134.

A circular first passage hole 135 is formed at the center of the first valve body 133. A plurality of second passage holes 136 are formed like slits circumferentially on the outer edge of the first valve body 133. The second passage holes 136 are formed around the first passage hole 135.

The first valve body 133 can be deformed to a closing position S1 (solid lines in FIG. 23 and FIG. 25) where the first valve body 133 retracts concavely into the inner cylinder 129 and an opening position O1 (virtual lines in FIG. 23 and FIG. 27) where the first valve body 133 expands convexly from the inside of the inner cylinder 129 into the spout cylinder 112. The first valve body 133 is biased in a closing direction A (see FIG. 23).

Figure 25:
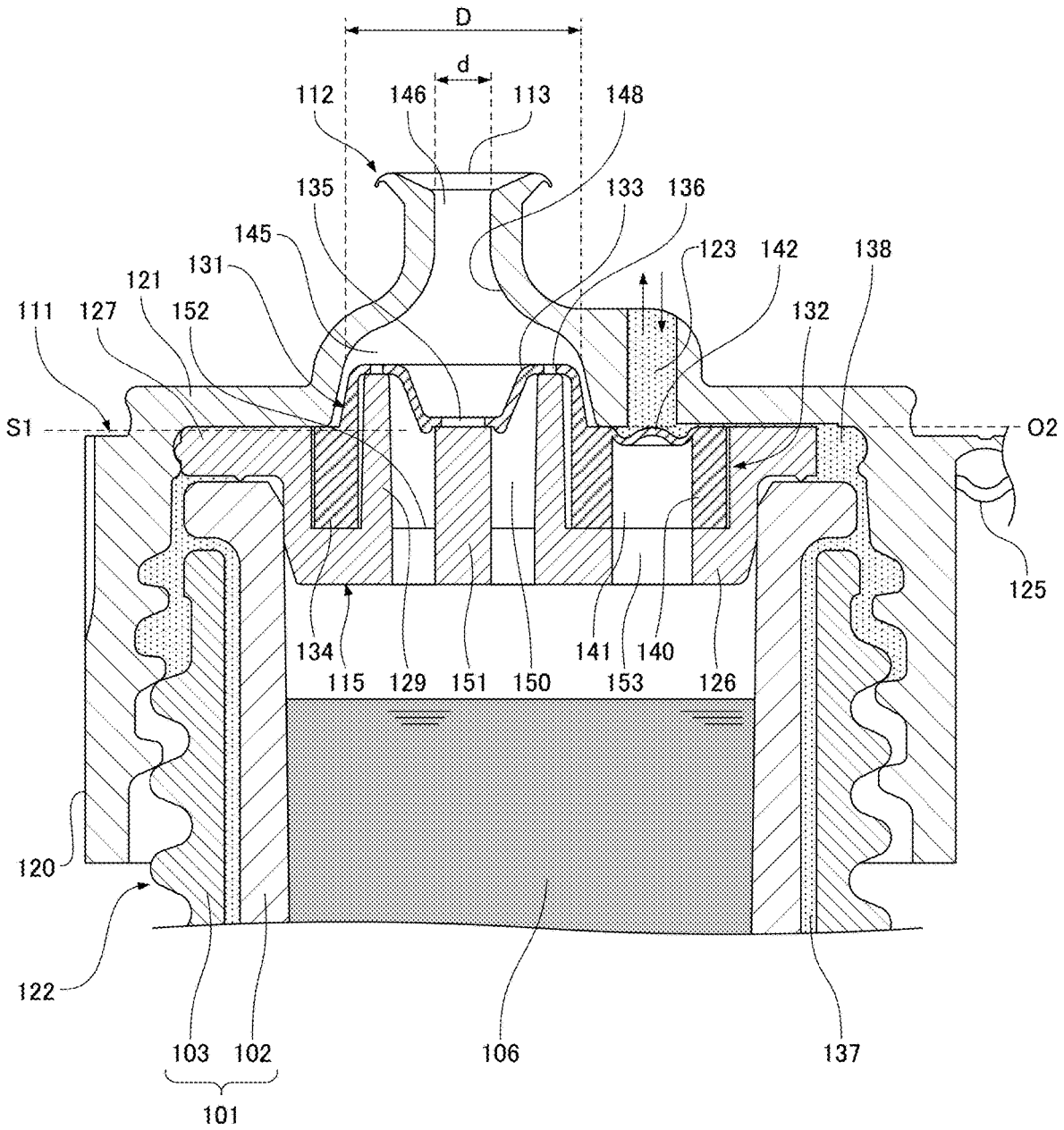
FIG. 25 is a cross-sectional view showing operations of first and second inner valves for the cap with a first valve body at a closing position and a second valve body at an opening position.

As shown in FIGS. 18 and 25, the first valve body 133 at the closing position S1 comes into contact with one end face (upper end face) of the closing member 151 and the other end face (upper end face) of the inner cylinder 129. Thus, the first passage hole 135 is closed by the end face of the closing member 151 and the second passage holes 136 are closed by the other end face of the inner cylinder 129, causing the first valve body 133 to act as a partition between the inside of the inner cylinder 129 and the inside of the spout cylinder 112.

Figure 27:
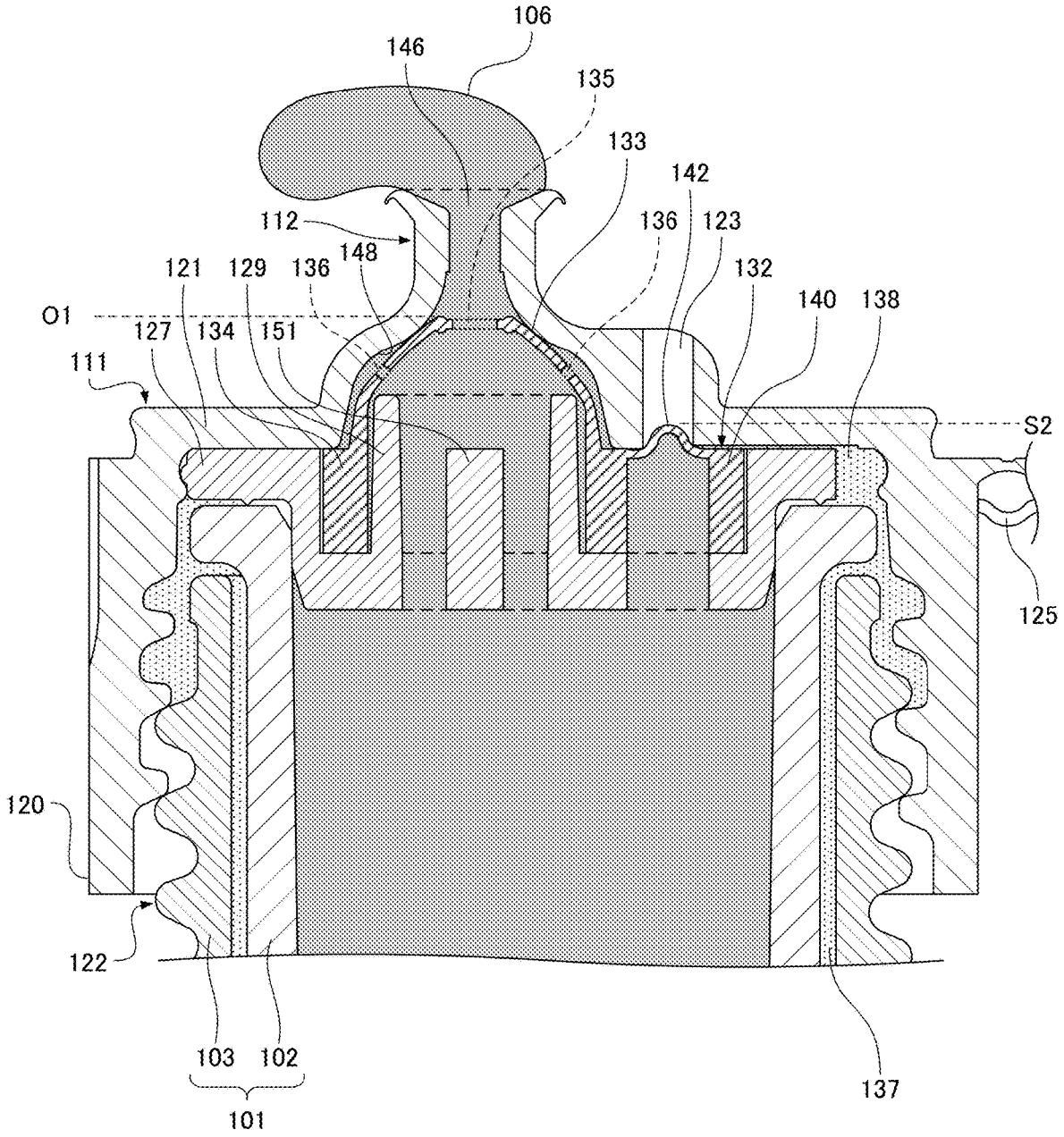
FIG. 27 is a cross-sectional view showing the operations of the first and second inner valves for the cap with the first valve body at the opening position and the second valve body kept at the closing position.

As shown in FIG. 27, if the first valve body 133 is deformed to the opening position O1, the first valve body 133 separates from the end face of the closing member 151 and the other end face of the inner cylinder 129, causing the inside of the inner cylinder 129 and the inside of the spout cylinder 112 to communicate with each other through the first and second passage holes 135 and 136.

As shown in FIGS. 18, 23, and 24, the second inner valve 132 is integrated with the first inner valve 131 so as to open and close the air inlet port 123. Furthermore, the second inner valve 132 includes a cylindrical second support cylinder 140, a feeding part 141 that feeds a content fluid 106 in the inner container 102, a thin circular second valve body 142 that can be elastically deformed so as to be opened and closed by the fluid 106 fed to the feeding part 141.

The second support cylinder 140 is integrally connected to the outer circumference of the first support cylinder 134 and is inserted into the depressed part 128 of the inner stopper 115. The feeding part 141 is formed inside the support cylinder 140 and communicates with the inside of the inner container 102 through a hole 153 (see FIG. 18) formed on the inner stopper 115.

The second valve body 142 is integrally provided on one end of the second support cylinder 140. The second valve body 142 can be elastically deformed to a closing position S2 (virtual lines in FIG. 23, FIGS. 26 and 27) where the second valve body 142 expands into the air inlet port 123 so as to close the air inlet port 123 and an opening position O2 (solid lines in FIG. 23, FIGS. 25 and 28) where the second valve body 142 retracts into the feeding part 141 from the inside of the air inlet port 123 so as to open the air inlet port 123. Moreover, the second valve body 142 is biased in an opening direction C (see FIG. 23) and is deformed from the opening position O2 to the closing position S2 by the content fluid 106 fed to the feeding part 141.

As shown in FIG. 25, the spout cylinder 112 has a storage part 145 that stores the first valve body 133 and a spout passage 146 that communicates with the spout 113 from the storage part 145. A diameter d of the spout passage 146 is smaller than a diameter D of the storage part 145.

The spout cylinder 112 has a guide surface 148 shaped like an arc in cross section. The guide surface 148 is formed so as to guide, to the spout passage 146, the content fluid 106 having flown to the storage part 145 in the spout cylinder 112 from the inside of the inner cylinder 129 through the second passage hole 136. Thus, the inside diameter of the spout cylinder 112 gradually decreases from the storage part 145 toward the spout passage 146.

The function of the configuration will be described below.

Figure 26:
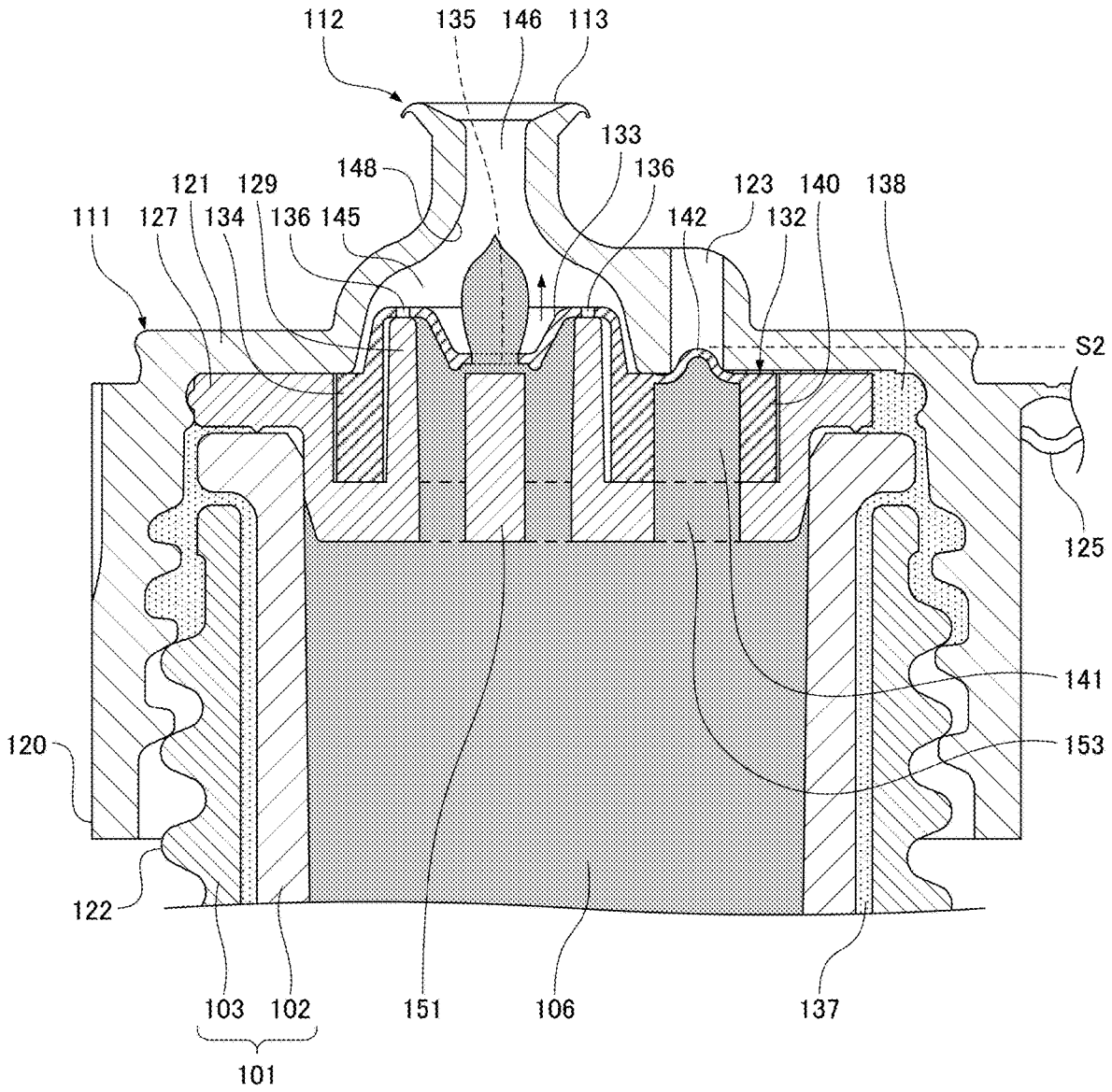
FIG. 26 is a cross-sectional view showing the operations of the first and second inner valves for the cap with the first valve body being deformed from the closing position toward the opening position and the second valve body deformed from the opening position to the closing position.

As shown in FIG. 25, a user opens the lid 114 and holds the double-walled container 101 in a tilted position with a hand, and then the user presses (compresses) the double-walled container 101 so as to deform the outer container 103. When the pressure of the clearance 137 between the inner container 102 and the outer container 103 exceeds an atmospheric pressure, as shown in FIG. 26, the content fluid 106 in the inner container 102 passes through the hole 153 and is fed to the feeding part 141, and then the second valve body 142 expands into the air inlet port 123 so as to close the air inlet port 123 at the closing position S2. Thus, the internal pressure of the double-walled container 101 increases and the first valve body 133 is deformed upward from the closing position S1 (see FIG. 25) where the first valve body 133 retracts concavely into the inner cylinder 129 to the opening position O1 (see FIG. 27) where the first valve body 133 expands convexly into the spout cylinder 112.

At this point, first as shown in FIG. 26, the first valve body 133 separates upward from the end face of the closing member 151 while being kept in contact with the other end face of the inner cylinder 129, the inside of the inner cylinder 129 and the inside of the spout cylinder 112 communicate with each other through the first passage hole 135, and the content fluid 106 in the inner container 102 flows into the spout cylinder 112 from the inside of the inner cylinder 129 through the first passage hole 135.

Just after that, as shown in FIG. 27, the first valve body 133 further expands upward so as to be deformed to the opening position O1. At this point, the first valve body 133 separates upward from the other end face of the inner cylinder 129, the inside of the inner cylinder 129 and the inside of the spout cylinder 112 communicate with each other through the first and second passage holes 135 and 136, and the content fluid 106 in the inner container 102 flows into the spout cylinder 112 from the inside of the inner cylinder 129 through the first and second passage holes 135 and 136 and then is discharged from the spout 113.

At this point, the content fluid 106 having flown to the storage part 145 in the spout cylinder 112 through the first and second passage holes 135 and 136 is guided to the guide surface 148, is smoothly collected into the spout passage 146 from the storage part 145, and then is discharged from the spout 113 through the spout passage 146. This can prevent a flow of the content fluid 106 from being disturbed in the spout cylinder 112.

Figure 28:
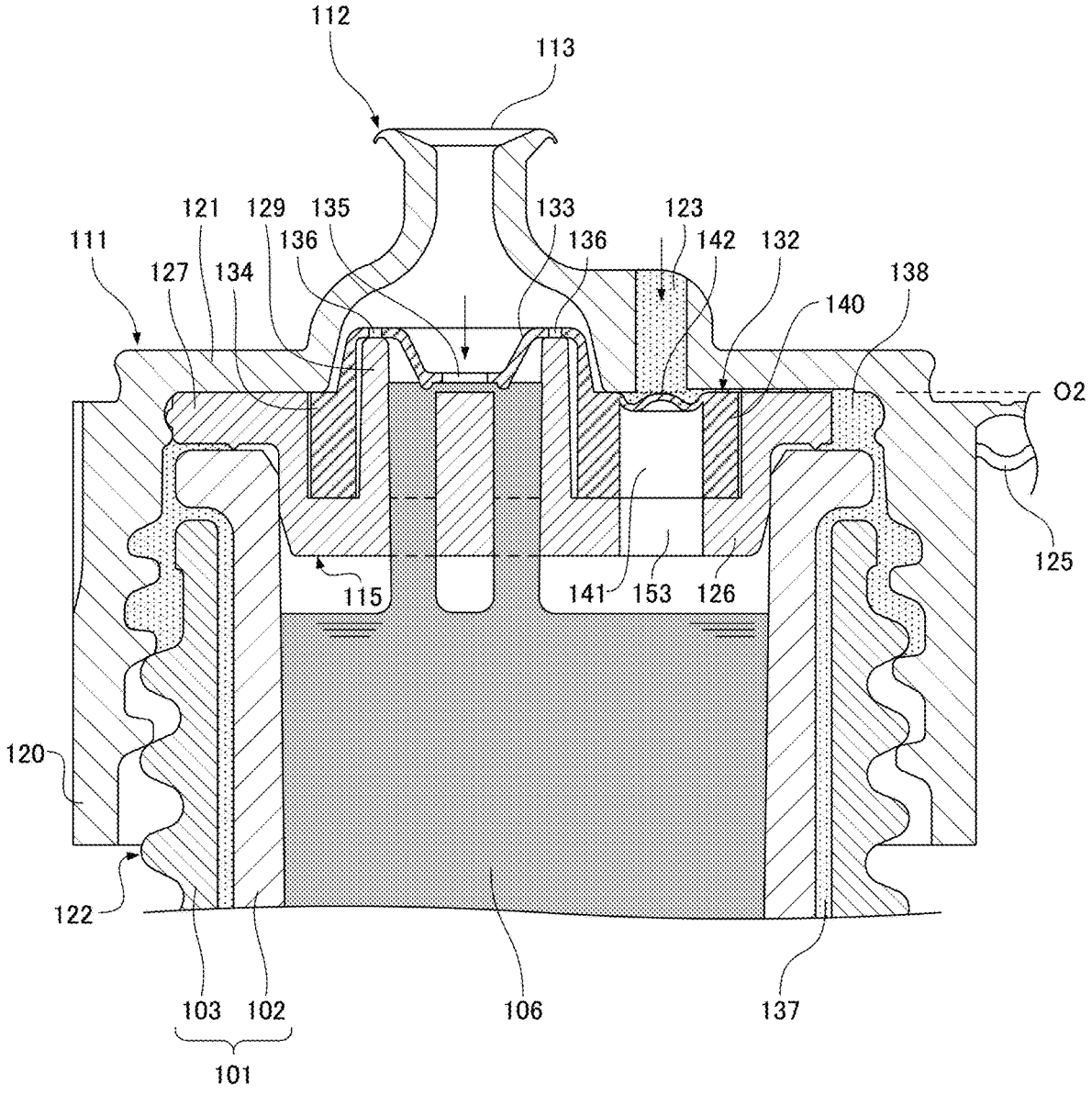
FIG. 28 is a cross-sectional view showing the operations of the first and second inner valves for the cap with the first valve body being deformed from the opening position toward the closing position and the second valve body deformed from the closing position to the opening position.
Figure 29:
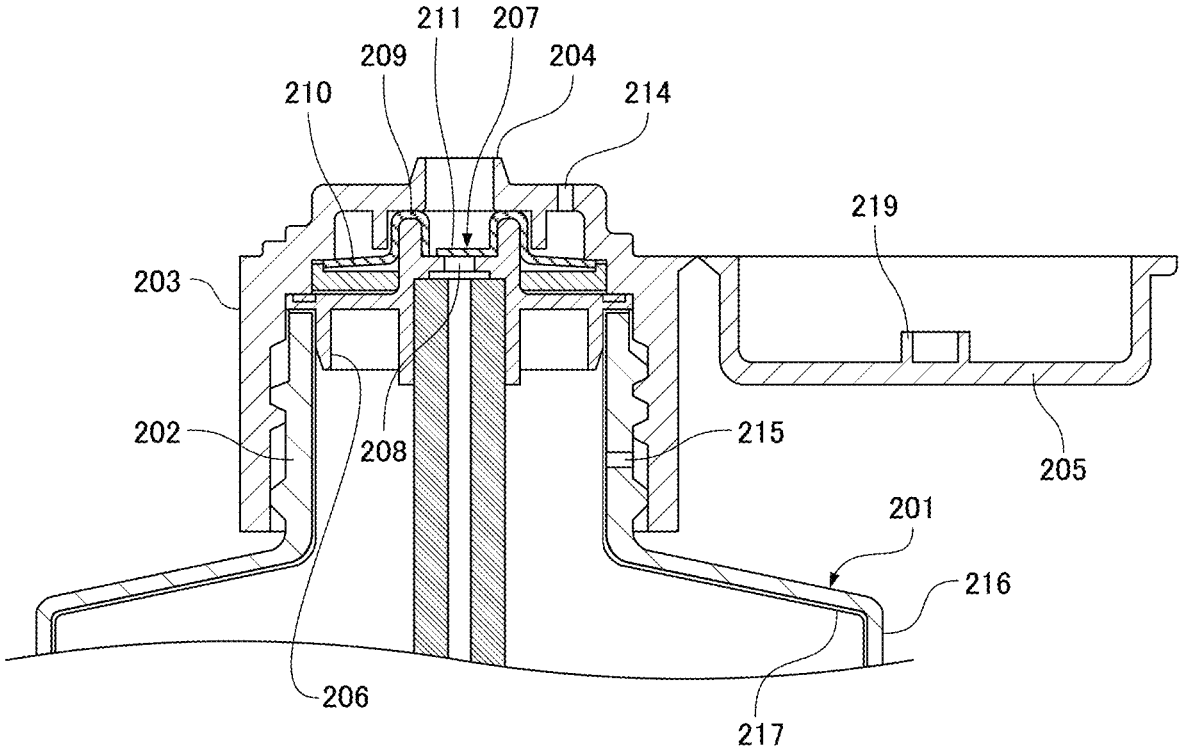
FIG. 29 is a cross-sectional view showing a cap according to the related art.
Figure 30:
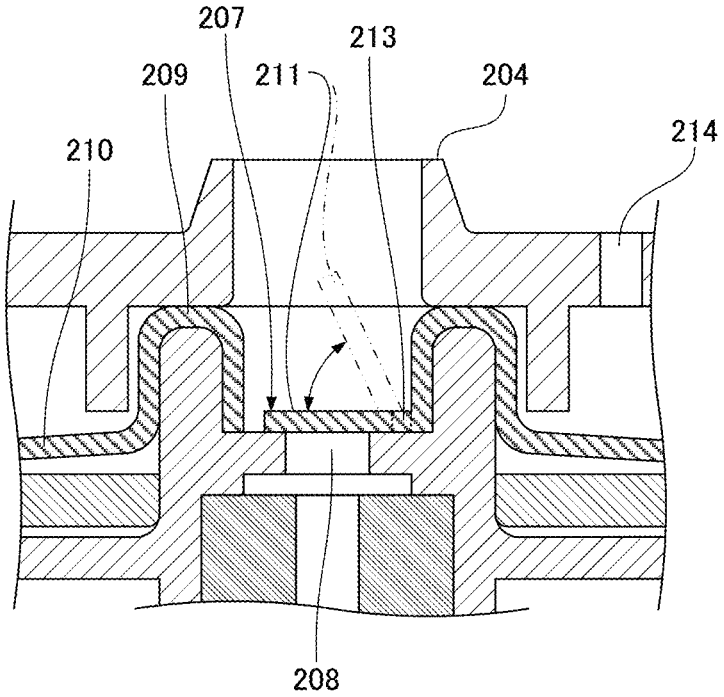
FIG. 30 is a partially enlarged cross-sectional view of the cap.
Figure 31:
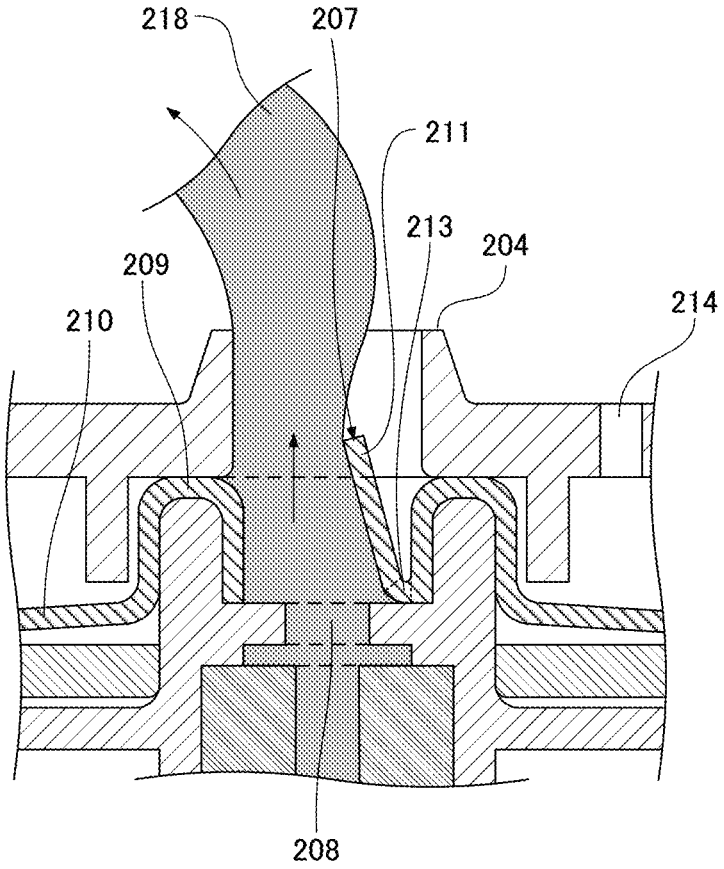
FIG. 31 is a partially enlarged cross-sectional view showing the cap with a discharge valve opened to discharge a content fluid from a spout to the outside.
Figure 32:
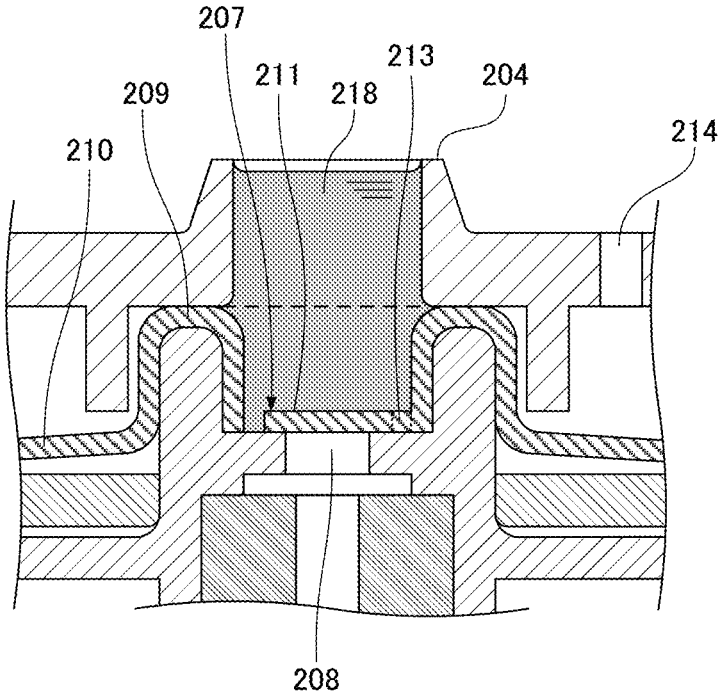
FIG. 32 is a partially enlarged cross-sectional view showing the cap with the discharge valve closed to leave a content fluid in a spout cylinder.

The user releases pressure on the double-walled container 101 to restore the outer container 103 to an original shape obtained before the press to the double-walled container 101. When the pressure of the clearance 137 between the inner container 102 and the outer container 103 falls below an atmospheric pressure, as shown in FIG. 28, the content fluid 106 passes through the hole 153 from the feeding part 141 and returns into the inner container 102, and then the second valve body 142 is deformed to the opening position O2, retracts into the feeding part 141 from the inside of the air inlet port 123, and opens the air inlet port 123.

Thus, air is fed into the clearance 137 between the inner container 102 and the outer container 103 from the air inlet port 123 through the communication passage 138, and the first valve body 133 is deformed downward from the opening position O1 (see FIG. 27) where the first valve body 133 is expands convexly into the spout cylinder 112 to the closing position S1 (see FIG. 25) where the first valve body 133 retracts concavely into the inner cylinder 129.

At this point, the content fluid 106 in the spout cylinder 112 first passes through the first and second passage holes 135 and 136 and then returns into the inner container 102 through the inner cylinder 129. Immediately after that, as shown in FIG. 28, the first valve body 133 comes into contact with the other end face of the inner cylinder 129, the second passage holes 136 are closed on the other end face of the inner cylinder 129, and the content fluid 106 in the spout cylinder 112 passes through only the first passage hole 135 and returns into the inner container 102.

Just after that, as shown in FIG. 25, the first valve body 133 is deformed to the closing position S1, the first valve body 133 comes into contact with the end face of the closing member 151, and the first passage hole 135 is closed on the end face of the closing member 151, causing the first valve body 133 to act as a partition between the inside of the inner cylinder 129 and the inside of the spout cylinder 112.

In this way, the first valve body 133 being closed is considerably deformed from a convex shape (see FIG. 27) expanding into the spout cylinder 112 to a concave shape (see FIG. 25) retracting into the inner cylinder 129, so that the content fluid 106 in the spout cylinder 112 is mostly drawn into the inner cylinder 129 according to the deformation of the first valve body 133. This can reduce the amount of the content fluid 106 remaining in the spout cylinder 112 after the first valve body 133 is closed, or prevent the content fluid 106 from remaining in the spout cylinder 112, thereby achieving an excellent effect of sucking the content fluid 106.

Even if the content fluid 106 remains in the spout cylinder 112, the amount of the remaining fluid 106 can be reduced thus. Hence, when the lid 114 is closed to insert the protrusion 154 into the spout cylinder 112, the content fluid 106 remaining in the spout cylinder 112 can be prevented from leaking out of the spout cylinder 112.

Under normal conditions where a user does not press the double-walled container 101 and the outer container 103 is not deformed (including the state where the user releases pressure on the double-walled container 101 to restore the outer container 103 to an original shape obtained before the press), as shown in FIG. 25, the content fluid 106 is returned into the inner container 102 from the feeding part 141. Thus, the second valve body 142 is deformed to the opening position O2 and the air inlet port 123 is kept opened.

Hence, for example, even if an inside of the double-walled container 101 reaches a higher temperature than outside and air thermally expands in the clearance 137 between the inner container 102 and the outer container 103, the thermally expanding air flows into the air inlet port 123 from the communication passage 138 and then is discharged out of the air inlet port 123. Thus, an internal pressure of the double-walled container 101 and an external pressure can be balanced under the normal conditions. This can prevent air in the clearance 137 between the inner container 102 and the outer container 103 from thermally expanding so as to raise a pressure in the double-walled container 101, thereby preventing the level of the content fluid 106 in the double-walled container 101 from rising without a press to the double-walled container 101 by a user.

When a user presses the double-walled container 101 to deform the outer container 103, a pressing force is lowered to reduce the deformation amount of the outer container 103. Thus, as shown in FIG. 26, the content fluid 106 can be discharged only through the first passage hole 135 while the second passage holes 136 are closed. In this case, the content fluid 106 discharged from the spout cylinder 112 is kept at a small amount. If a pressing force is increased to raise the deformation amount of the outer container 103, as shown in FIG. 27, the content fluid 106 can be discharged from both of the first passage hole 135 and the second passage holes 136. In this case, a large amount of the content fluid 106 is discharged from the spout cylinder 112. In this way, a pressing force applied to the double-walled container 101 by the user is increased or reduced so as to adjust the amount of the content fluid 106 discharged from the spout cylinder 112.

In the foregoing embodiments, as shown in FIGS. 2 and 25, the guide surfaces 48 and 148 are arc-shaped in cross section. The guide surfaces 48 and 148 may be tapered surfaces.

What is claimed is:

1. A container assembly comprising a cap attached to a mouth of a double-walled container having a deformable inner container and a deformable outer container, the cap comprising:

a main unit attached to the mouth of the double-walled container;

a spout cylinder provided on the main unit;

a lid that opens and closes a spout formed at a tip end of the spout cylinder;

an inner stopper that is provided in the main unit so as to be fit into the mouth of the double-walled container; and a first inner valve provided retained in the main unit, wherein the inner stopper includes an inner cylinder with one end communicating with an inside of the inner container and the other end communicating with an inside of the spout cylinder, the first inner valve includes a first valve body that covers an opening of the inner cylinder, the first valve body has at least one passage hole, the first valve body is deformable to an opening position where the first valve body expands deforms convexly into the spout cylinder and to a closing position where the first valve body retracts concavely into the inner cylinder, the first valve body being biased in a closing direction, the first valve body at the closing position acts as a partition between the inside of the inner cylinder and the inside of the spout cylinder, and the first valve body at the opening position causes the inside of the inner cylinder and the inside of the spout cylinder to communicate with each other through the passage hole of the first valve body, the passage hole has a first passage hole that is formed at a center of the first valve body, the inner cylinder contains a communicating path that communicates with the inside of the inner container and the inside of the spout cylinder, and contains a closing member, the first valve body at the closing position comes into contact with the closing member and closes the first passage hole with the closing member, and the first valve body at the opening position separates from the closing member, causing the inside of the inner cylinder and the inside of the spout cylinder to communicate with each other through the first passage hole the passage hole has at least one second passage hole formed around the first passage hole, the first valve body at the closing position comes into contact with an end of the inner cylinder and closes the second passage hole on the end of the inner cylinder, and the first valve body at the opening position separates from the end of the inner cylinder, causing the inside of the inner cylinder and the inside of the spout cylinder to communicate with each other through the first and second passage holes.

2. A container assembly comprising a cap attached to a mouth of a double-walled container having a deformable inner container and a deformable outer container, the cap comprising:

a main unit attached to the mouth of the double-walled container;

a spout cylinder provided on the main unit;

a lid that opens and closes a spout formed at a tip end of the spout cylinder;

an inner stopper that is provided in the main unit so as to be fit into the mouth of the double-walled container; and a first inner valve retained in the main unit, wherein the inner stopper includes an inner cylinder with one end communicating with an inside of the inner container and the other end communicating with an inside of the spout cylinder, the first inner valve includes a first valve body that covers an opening of the inner cylinder, the first valve body has at least one passage hole, the first valve body is deformable to an opening position where the first valve body deforms convexly into the spout cylinder and to a closing position where the first valve body retracts concavely into the inner cylinder, the first valve body being biased in a closing direction, and the first valve body at the closing position acts as a partition between the inside of the inner cylinder and the inside of the spout cylinder, the first valve body at the opening position causes the inside of the inner cylinder and the inside of the spout cylinder to communicate with each other through the passage hole of the first valve body, wherein the main unit has an air inlet port that draws outside air into a clearance between the inner container and the outer container, the main unit contains a communication passage that communicates with the air inlet port and the clearance between the inner container and the outer container, and contains a second inner valve that opens and closes the air inlet port, and the second inner valve is integrated with the first inner valve.

3. The container assembly according to claim 2, wherein the second inner valve includes a feeding part that feeds a content fluid of the inner container and a second valve body that is opened and closed by the content fluid fed by the feeding part, the second valve body is deformable to a closing position where the second valve body expands into the air inlet port so as to close the air inlet port and to an opening position where the second valve body retracts into the feeding part from the inside of the air inlet port so as to open the air inlet port, the second valve body being biased in an opening direction and deformed from the opening position to the closing position by the content fluid fed by the feeding part.

* * * * *